US007959489B2

(12) United States Patent
Shaffstall

(10) Patent No.: US 7,959,489 B2
(45) Date of Patent: Jun. 14, 2011

(54) DEVICES AND METHODS FOR SECURING A CLOTHING STRAP

(76) Inventor: Cyndie L. Shaffstall, Lakewood, CO (US)

( * ) Notice: Subject to any disclaimer, the term of this patent is extended or adjusted under 35 U.S.C. 154(b) by 855 days.

(21) Appl. No.: 11/765,847

(22) Filed: Jun. 20, 2007

(65) Prior Publication Data

US 2007/0298683 A1 Dec. 27, 2007

Related U.S. Application Data

(60) Provisional application No. 60/815,793, filed on Jun. 22, 2006.

(51) Int. Cl.
*A41C 3/00* (2006.01)
*A41F 1/00* (2006.01)

(52) U.S. Cl. ..... 450/86; 450/1; 2/336; 2/327; 24/592.1; 24/200; 24/303

(58) Field of Classification Search ..... 2/336, 338, 2/326, 327; 450/86, 88; 24/592.1, 593.1, 24/593.11, 163 FC, 578.1, 578.14, 903, 114, 24/163 R, 169–171, 173, 177–179, 191, 194, 24/195, 197, 200, 303; 223/1, 28, 69, 71, 223/97, 85

See application file for complete search history.

(56) References Cited

U.S. PATENT DOCUMENTS

| | | | | | |
|---|---|---|---|---|---|
| 702,667 | A | * | 6/1902 | Murphy | 2/57 |
| 1,489,731 | A | * | 4/1924 | Baldwin | 24/532 |
| 2,444,806 | A | * | 7/1948 | Cleasby | 2/336 |
| 4,612,935 | A | * | 9/1986 | Greifer | 450/86 |
| 4,658,479 | A | * | 4/1987 | Sanders | 24/67.9 |
| 4,665,594 | A | * | 5/1987 | Wagner | 24/546 |
| D290,971 | S | * | 7/1987 | Quilty | D19/65 |
| D293,337 | S | * | 12/1987 | Burgdorf | D19/65 |
| D303,272 | S | * | 9/1989 | Lorber | D19/65 |
| 5,010,629 | A | * | 4/1991 | Hirzel | 24/67.9 |
| 5,149,293 | A | * | 9/1992 | Gable | 450/86 |
| D369,129 | S | * | 4/1996 | Fildan | D11/210 |
| 5,590,545 | A | * | 1/1997 | Norris | 24/563 |
| 5,799,842 | A | * | 9/1998 | Rumsey | 223/1 |
| 5,935,044 | A | * | 8/1999 | Brewster | 450/86 |
| D432,946 | S | * | 10/2000 | Gorelick | D11/200 |
| 6,163,937 | A | * | 12/2000 | McKinnis et al. | 24/302 |
| 6,336,578 | B1 | * | 1/2002 | Maynard | 224/248 |
| 6,381,752 | B1 | * | 5/2002 | Cartelli | 2/86 |
| 6,618,862 | B1 | * | 9/2003 | Bunjes | 2/232 |
| D486,294 | S | * | 2/2004 | Stuntz et al. | D2/705 |
| D572,626 | S | * | 7/2008 | Merriam-Smith | D11/200 |
| 7,410,407 | B2 | * | 8/2008 | Krammel | 450/58 |
| D583,706 | S | * | 12/2008 | Gilbert | D11/210 |

* cited by examiner

*Primary Examiner* — Gloria Hale
(74) *Attorney, Agent, or Firm* — Christensen O'Connor Johnson Kindness PLLC

(57) ABSTRACT

Devices, methods, and kits for securing clothing, in particular, for securing a bra strap to a blouse strap. The device includes a long, thin material, having a first end, a second end, and a body extending between the first end and the second end. The long, thin material is formed into a plurality of opposing segments. A first of the plurality of opposing segments is continuous with a first end of a second of the plurality of the opposing segments at a first junction, and a first end of the third of the plurality of opposing segments is continuous with a second end of the second of the plurality of the opposing segments at a second junction. A fourth of the plurality of opposing segments is continuous with a second end of the third of the plurality of the opposing segments at a third junction.

17 Claims, 17 Drawing Sheets

DEVICES AND METHODS FOR SECURING A CLOTHING STRAP

CROSS-REFERENCE TO RELATED APPLICATION

This application claims the benefit of U.S. Provisional Application No. 60/815,793, filed Jun. 22, 2006, which application is incorporated herein by reference in its entirety.

BACKGROUND OF THE INVENTION

Various blouses exist that include thin straps extending over the wearer's shoulder to maintain the blouse in place. A similar strap exists on a bra extending over the shoulder to maintain the bra securely. Unfortunately, wearing both articles of clothing at the same time can result in an untidy appearance as the strap of the bra and the strap of the blouse often separate, as shown in FIG. 1. In particular, as shown in FIG. 1, a blouse 130 including a blouse strap 120 is worn by a person 100 such that it is draped by blouse strap 120 over a shoulder 140 of person 100 above an arm 150. Person 100 is further wearing a bra (not shown) that is secured over shoulder 100 by a bra strap 110. As shown, blouse strap 120 is separate from underlying bra strap 110. Such separation often results in an undesirable appearance leaving both the wearer and those around the wearer uncomfortable.

Thus, for at least the aforementioned reasons, there exists a need in the art for advanced devices and methods for securing clothing straps. The present invention seeks to fulfill these needs and provides further related advantages.

SUMMARY OF THE INVENTION

The present invention provides devices, kits and methods for securing clothing and, optionally, an adornment to clothing. In particular, the present invention provides devices, kits and methods for securing the strap of a blouse to the strap of a bra.

In one aspect, the present invention provides devices for securing two or more clothing straps. Such devices include a long, thin material that has a first end and a second end with a body extending between the first end and the second end. The long, thin material is formed into at least five opposing, weavable elements. In some cases, the long, thin material is metal, plastic, rubber, vinyl, or some combination of the aforementioned. In particular cases, the long, thin material is a metal wire.

In some instances of the aforementioned embodiments, the body of the long, thin material is formed such that the first end of the long, thin material is directed into the body of the long, thin material, whereby a potential of injury associated with the first end is reduced. In some cases, the long, thin material is formed such that the first end is associated with an eyelet that is operable to attach to an adornment.

In various instances of the aforementioned embodiments, the body includes a first body section, a second body section, and a third body section. In such instances, the first body section includes at least three of the five opposing, weavable elements, the second body section includes at least two of the opposing, weavable elements, and the third body section is an elongated section extending between the first body section and the second body section. In some cases, the long, thin material of the first body section is formed into a first spiral including the at least three of the five opposing, weavable elements, and the long, thin material of the second body section is formed into a second spiral including the at least two of the five opposing, weavable elements. In particular cases, a bead is attached between the first end and the first body portion. In such cases, the bead may be operable to limit movement of a strap secured using the device.

In yet other instances of the aforementioned embodiments, the long, thin material is formed in a serpentine shape including at least five transverse sections. In such cases, the five opposing, weavable elements are respective ones of the five transverse sections of the serpentine shape. In some cases, a bead is added at one of the junctions between proximate ones of the transverse sections of the serpentine. The aforementioned bead may be operable to limit movement of a secured strap. In some cases, another bead may be added between a transverse section of the serpentine nearest the first end and the first end itself. This bead may also be used to limit movement of the secured strap.

In yet other instances of the aforementioned embodiments, the long, thin material is formed into at least six opposing, weavable elements that are grouped into a first set of three opposing, weavable elements and a second set of three opposing weavable elements. In such cases, one of the three opposing, weavable elements of the first set of opposing weavable elements is also one of the three opposing, weavable elements of the second set of opposing, weavable elements. In such a case, one of the first set of three opposing, weavable elements is disposed on a first plane and the other two of the first set of three opposing weavable elements are disposed on a second plane. Further, one of the second set of three opposing, weavable elements is disposed on the first plane and the other two of the second set of three opposing weavable elements is disposed on the second plane. In some of the aforementioned cases, the opposing, weavable elements on the second plane may be substantially parallel. Further, the opposing, weavable element of the first set of opposing, weavable elements disposed on the first plane may be shaped substantially different from the opposing, weavable element of the second set of opposing, weavable elements disposed on the first plane.

In another aspect, the present invention provides clothing securing kits.

In one embodiment, the kit of the invention includes at least one securing device. The securing device includes a long, thin material that has a first end and a second end with a body extending between the first end and the second end. The long, thin material is formed into a plurality of opposing, weavable elements. A first of the plurality of opposing weavable elements is continuous with a first end of a second of the plurality of the opposing, weavable elements at a first junction. A first end of the third of the plurality of opposing, weavable elements is continuous with a second end of the second of the plurality of the opposing, weavable elements at a second junction. A fourth of the plurality of opposing, weavable elements is continuous with a second end of the third of the plurality of the opposing, weavable elements at a third junction. The first end is associated with an attachment point. The securing device further includes a detachable adornment that is operable to attach and detach from the attachment point.

In some instances of the aforementioned embodiments, the kit further includes another securing device that is similar to the first securing device.

In another aspect, the present invention provides methods for securing clothing.

Various embodiments of the present invention provide methods for securing a bra strap to a blouse strap. Such methods include providing a securing device that includes a long, thin material. The long, thin material has a first end and a second end with a body extending between the first end and the second end, and the long, thin material is formed into a plurality of opposing, weavable elements. A first of the plurality of opposing weavable elements is continuous with a first end of a second of the plurality of the opposing, weavable elements at a first junction, and a first end of the third of the plurality of opposing, weavable elements is continuous with a second end of the second of the plurality of the opposing, weavable elements at a second junction. A fourth of the plurality of opposing, weavable elements is continuous with a second end of the third of the plurality of the opposing, weavable elements at a third junction.

The aforementioned methods further include placing at least two straps together to form a strap group and performing a weave where the strap group is fed past the first of the opposing, weavable elements, past the second of the opposing weavable elements, past the third of the opposing, weavable elements, and past the fourth of the opposing, weavable elements. Upon doing such, the first junction encases the strap group at one side of the strap group, and the second junction encases the strap group at an opposite side of the strap group. In some instances of the aforementioned embodiments, feeding the strap group past the first of the opposing, weavable elements includes going over the first of the opposing, weavable elements; feeding the strap group past the second of the opposing, weavable elements includes going under the second of the opposing, weavable elements; feeding the strap group past the third of the opposing, weavable elements includes going over the third of the opposing, weavable elements; and feeding the strap group past the fourth of the opposing, weavable elements includes going under the fourth of the opposing, weavable elements. In other instances of the aforementioned embodiments, feeding the strap group past the first, second and third of the opposing, weavable elements includes passing the strap group between and under the first and third of the opposing, weavable elements and over the second of the opposing weavable elements.

In another aspect, the present invention provides methods for decorating clothing.

In one embodiment, the method comprises:

providing a device, wherein the device includes a long, thin material, wherein the long, thin material has a first end and a second end with a body extending between the first end and the second end, and wherein the long thin material is formed into at least five opposing, weavable elements; and performing a weave, wherein a strap of the clothing is fed passed the first of the opposing, weavable elements, passed the second of the opposing weavable elements, passed the third of the opposing, weavable elements, and passed the fourth of the opposing, weavable elements; wherein the first injunction encases the strap group at one side of the strap group, and wherein the second injunction encase the strap group at an opposite side of the strap group.

In one embodiment, the method could further include attaching an adornment to the device.

In another aspect, the present invention provides devices for decorating clothing.

In one embodiment, the device comprises a long, thin material, wherein the long, thin material has a first end and a second end with a body extending between the first end and the second end, and wherein the long, thin material is formed into at least two opposing, weavable elements.

In one embodiment, the long, thin material of the device is formed such that the first end is associated with an eye, and wherein the eyelet is operable to attach to an adornment.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

Figure 1:
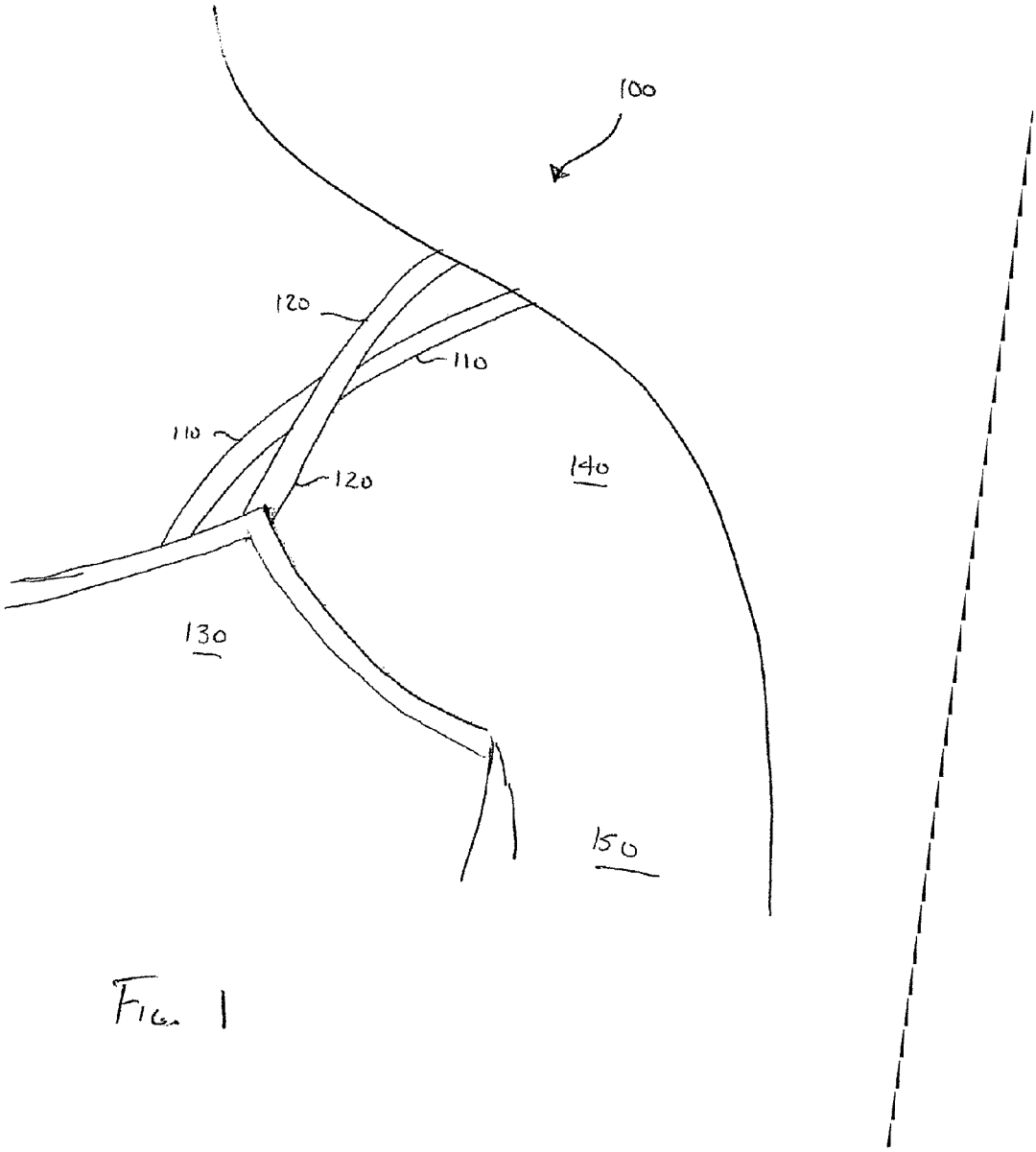
FIG. 1 depicts a prior art unsecured blouse strap and bra strap.

The present invention is related to methods, devices and kits for securing clothing and, in particular, to methods, devices and kits for securing the strap of a blouse to the strap of a bra.

As used herein, the phrase "long, thin material" is used in its broadest sense to mean any material with a length more than three times its width and its thickness. Thus, for example, a piece of round metal wire with a length greater than three times its diameter would be considered a long, thin material. Also, as used herein, the phrase "opposing, weavable element" is used in its broadest sense to mean a segment that opposes one or more other segments such that adjacent garment shoulder straps may be secured together, intertwined between opposing segments. Further, as used herein, the term "junction" is used in its broadest sense to mean an arbitrarily defined location where two segments come together or where the end of one segment meets the beginning of another segment.

In one aspect, the present invention provides a device for securing two clothing straps.

The securing devices in the present invention may be generally used to secure two or more garment shoulder straps together such as, for example, a bra shoulder strap and a blouse shoulder strap.

In one embodiment, the device comprises a long, thin material, wherein the long, thin material has a first end and a second end with a body extending between the first end and the second end, and wherein the long, thin material is formed into at least five opposing, weavable elements.

Any suitable material can be used for the present invention. For example, the long, thin material can be metal, plastic, rubber, vinyl, or a mixture thereof. In one embodiment, the long, thin material is a metal wire.

In one embodiment, the body of the long, thin material is formed such that the first end of the long, thin material is directed into the body of the long, thin material.

Variety of adornments can be attached to the securing device of the present invention. In some cases, one or more adornments may be attached to the securing devices for aesthetic purposes. In particular cases, the adornments may be detachable from the securing device allowing for interchanging such adornments.

A number of securing devices and associated adornments are discussed herein. Turning to FIG. 2A, a securing device kit 290 including a pair of spiral securing devices 210 in accordance with one or more embodiments of the present invention is shown. Each securing device 210 is made of a long, thin material that is formed into a spiral shape. The long, thin material may be, but is not limited to, metal wire, plastic, vinyl coated metal wire, enamel coated metal wire, or rubber coated metal wire. Based on the disclosure provided herein, one of ordinary skill in the art will recognize a variety of long, thin materials that may be used in accordance with one or more embodiments of the present invention.

As shown, the long, thin material includes two ends 220, 225 and is formed into a number of opposing, weavable elements 232, 234, 236, 238, 240. Opposing, weavable element 232 is continuous with opposing, weavable element 234 where one end of opposing, weavable element 232 meets an end of opposing, weavable element 234 at a junction 242. Opposing, weavable element 234 is continuous with opposing, weavable element 236 where one end of opposing, weavable element 234 meets an end of opposing, weavable element 236 at a junction 244. Opposing, weavable element 236 is continuous with opposing, weavable element 238 where one end of opposing, weavable element 236 meets an end of opposing, weavable element 238 at a junction 246. Opposing, weavable element 238 is continuous with opposing, weavable element 240 where one end of opposing, weavable element 238 meets an end of opposing, weavable element 240 at a junction 248.

In one particular embodiment of the present invention, securing devices 210 are created by taking a length of metal wire and bending it into the shown form to create the opposing, weavable elements. In some cases, the wire is a copper wire having a width between wire gauge fourteen and eighteen. In one particular case, an enamel covered copper wire of wire gauge sixteen is used. Such a width provides substantial sturdiness, while maintaining a reasonable weight and slenderness for the securing device. In some other cases, sterling silver or gold filled metal wire with a width between wire gauge fourteen and eighteen is used. In one particular case, a sterling silver wire of wire gauge sixteen is used, while in another particular case a gold filled wire of wire gauge sixteen is used. In other embodiments of the present invention, securing devices 210 are created by molding a continuous plastic piece that has a shape defined by the depicted opposing, weavable elements. Based on the disclosure provided herein, one of ordinary skill in the art will recognize a variety of manufacturing methods and materials that may be employed to create securing devices 210 in accordance with various embodiments of the present invention.

Figure 2B:
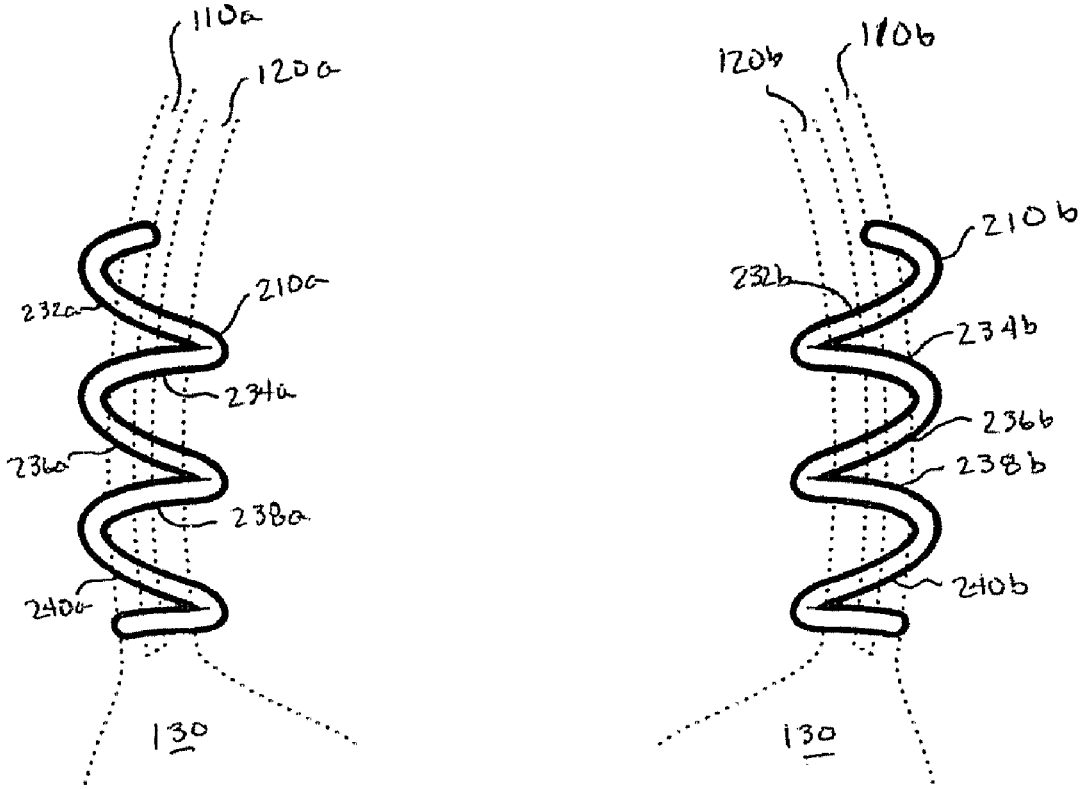
FIG. 2B depicts a pair of spiral securing devices of FIG. 2A deployed in relation to a bra strap and a blouse strap in accordance with some embodiments of the present invention.
Figure 2A:
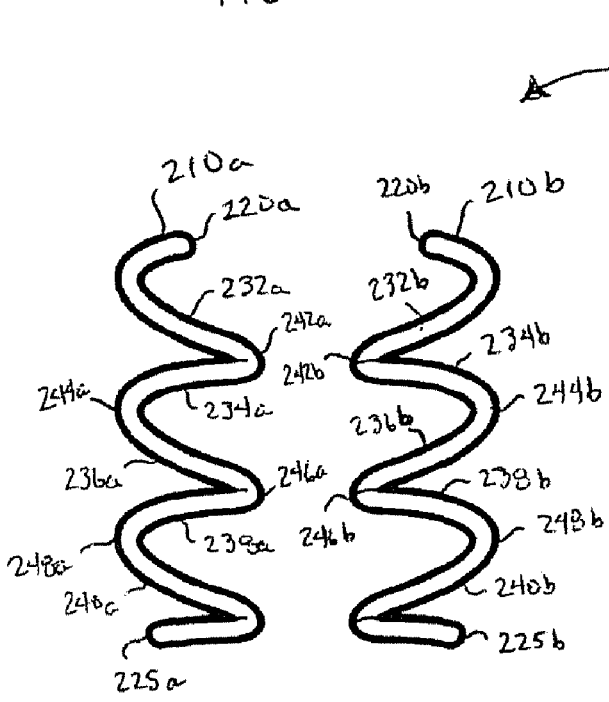
FIG. 2A depicts a kit including a pair spiral securing devices in accordance with one or more embodiments of the present invention.

As shown in FIG. 2B, securing devices 210 may be used to secure blouse shoulder strap 120 associated with blouse 130 to an underlying and adjacent bra shoulder strap 110 for the same shoulder of the wearer. Of note, each of blouse 130, bra strap 110, and blouse strap 120 is shown with dashed lines. Opposing, weavable elements 232, 234, 236, 238, 240 alternate going over and under the secured shoulder straps to intertwine with the straps and secure them together. In particular, opposing, weavable element 232 extends behind bra strap 110 and blouse strap 120, and the next opposing, weavable element 234 extends over bra strap 110 and blouse strap 120. As shown, this alternating pattern is repeated for adjacent opposing, weavable elements 234, 236, 238, 240. By alternating as shown, bra strap 110 and blouse strap 120 are secured together by securing devices 210.

Figure 2C:
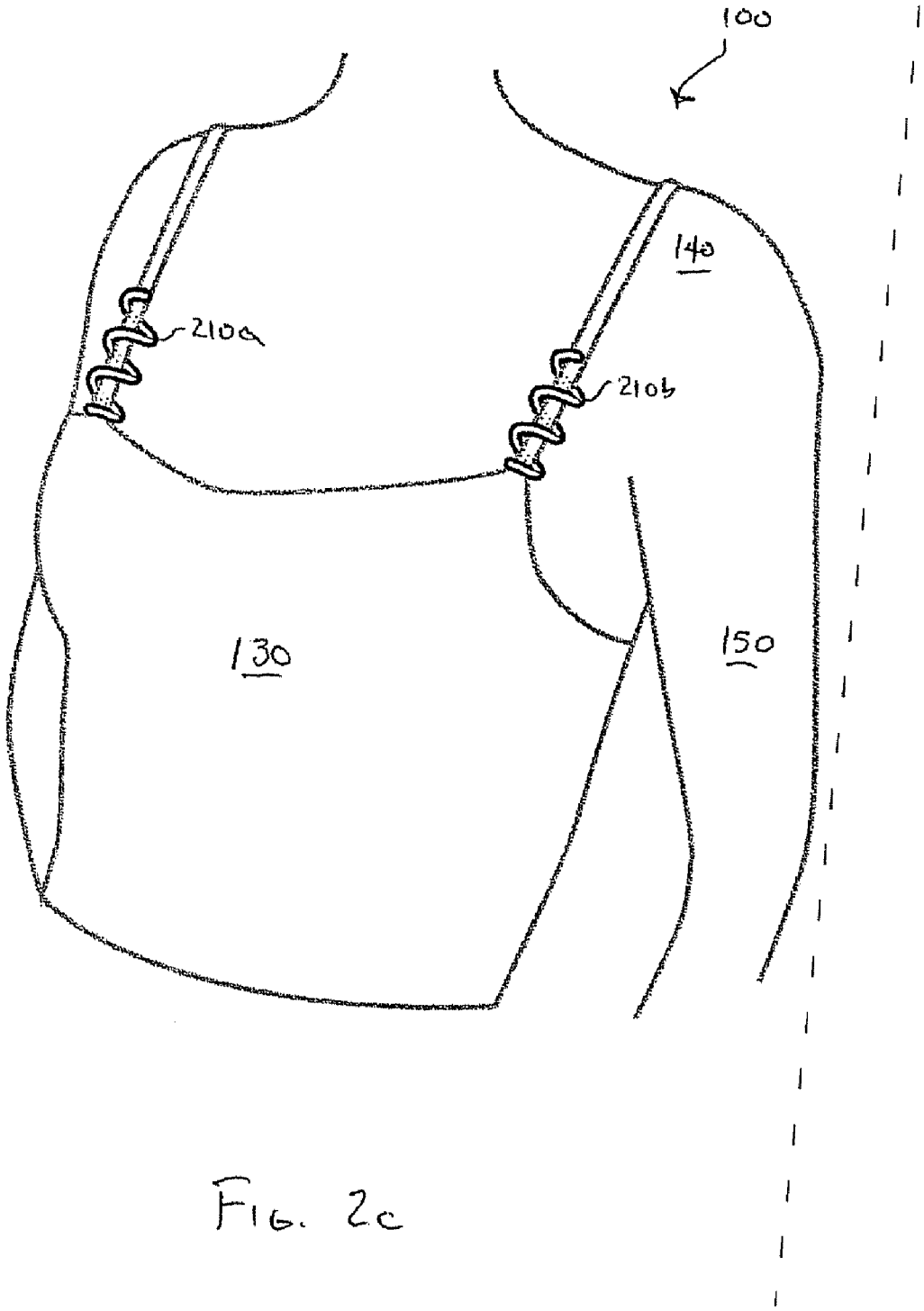
FIG. 2C shows the deployment of FIG. 2B in relation to a person wearing the blouse and bra.

Deploying securing devices 210 includes weaving bra strap 110 and blouse strap 120 over and past opposing, weavable element 232, under and past opposing weavable element 234, over and past opposing, weavable element 236, under and passed opposing, weavable element 238, and over and past opposing, weavable element 240. Upon doing such, junction 242 encases both of the straps on one side of the group of straps and junction 244 encases the group of straps on the opposite side. The same is true of junction 246 and junction 248. FIG. 2C shows securing devices 210 deployed in relation to a person 100 wearing blouse 130.

Figure 3B:
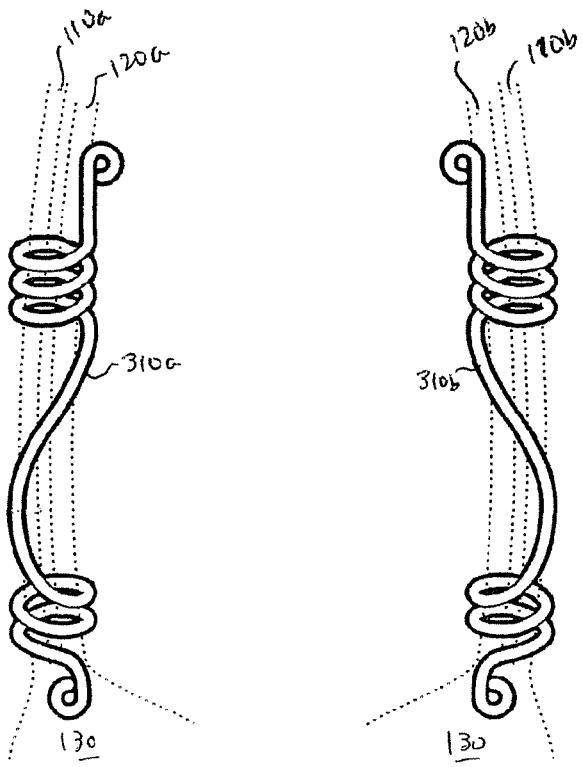
FIGS. 3A-3C depict dual spiral securing devices in accordance with some embodiments of the present invention.
Figure 3A:
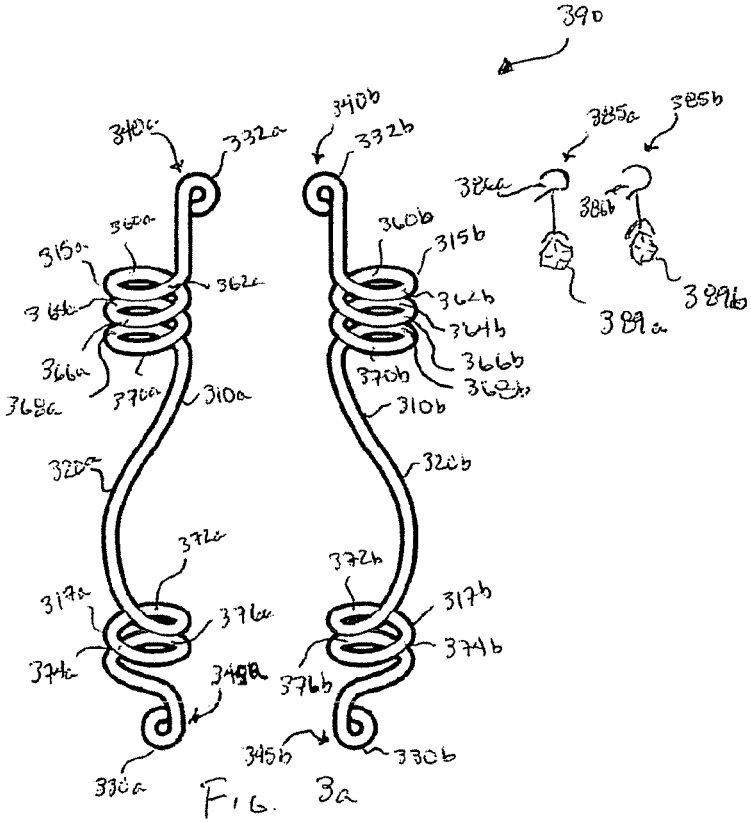

Turning to FIG. 3A, a securing device kit 390 including a pair of dual spiral securing devices 310 and a pair of adornments 385 in accordance with one or more embodiments of the present invention is shown. Adornments 385 may be any decorative item that can be attached either permanently or temporarily to securing devices 310. In the illustrated case, adornments 389 include a jewel 389 permanently attached thereto. Based on the disclosure provided herein, one of ordinary skill in the art will recognize a number of adornments that may be used in relation to one or more embodiments of the present invention. Each securing device 310 is made of a long, thin material that is formed into a pair of spirals 315, 317 with an intervening length 320. The long, thin material may be, but is not limited to, metal wire, plastic, vinyl coated metal wire, enamel coated metal wire, or rubber coated metal wire. Again, based on the disclosure provided herein, one of ordinary skill in the art will recognize a variety of long, thin materials that may be used in accordance with one or more embodiments of the present invention.

As shown, the long, thin material includes two ends 340, 345 and is formed into two spirals 315, 317, each comprising a number of opposing, weavable elements. In particular, spiral 315 includes opposing, weavable elements 360, 362, 364, 366, 368, 370 and spiral 317 includes opposing, weavable elements 372, 374, 376. Each of the opposing, weavable elements is continuous with the adjacent opposing, weavable element(s). End 340 is formed to include an eyelet 332 and end 345 is bent to form an eyelet 330. Such bending renders a potentially sharp end of securing device 310 from sticking a user of the device and also provides for an eyelet to which adornment 385 may be attached using a clasp 386 thereof.

In one particular embodiment of the present invention, securing devices 310 are created by taking a length of metal wire and bending it into the shown form to create the opposing, weavable elements. In some cases, the wire is a copper wire having a width between wire gauge fourteen and eighteen. In one particular case, an enamel covered copper wire of wire gauge sixteen is used. Such a width provides substantial sturdiness, while maintaining a reasonable weight and slenderness for the securing device. In some other cases sterling silver or gold filled metal wire with a width between wire gauge fourteen and eighteen is used. In one particular case, a sterling silver wire of wire gauge sixteen is used, while in another particular case a gold filled wire of wire gauge sixteen is used. In other embodiments of the present invention, securing devices 310 are created by molding a continuous plastic piece that has a shape defined by the depicted opposing, weavable elements. Based on the disclosure provided herein, one of ordinary skill in the art will recognize a variety of manufacturing methods and materials that may be employed to create securing devices 410 in accordance with various embodiments of the present invention.

As shown in FIG. 3B, securing devices 310 may be used to secure blouse strap 120 associated with blouse 130 to an underlying bra strap 110. Of note, each of blouse 130, bra strap 110 and blouse strap 120 is shown with dashed lines. Opposing, weavable elements 360, 362, 364, 366, 368, 370, 372, 374, 376 alternate going over and under the secured clothing. In particular, opposing, weavable element 360 extends behind bra strap 110 and blouse strap 120, and the next opposing, weavable element 362 extends over bra strap 110 and blouse strap 120. As shown, this alternating pattern is repeated for adjacent opposing, weavable elements 364, 366, 368, 370, 372, 374, 376 in each of the two spirals 315, 317. By alternating as shown, bra strap 110 and blouse strap 120 are secured together by securing devices 310.

Figure 3C:
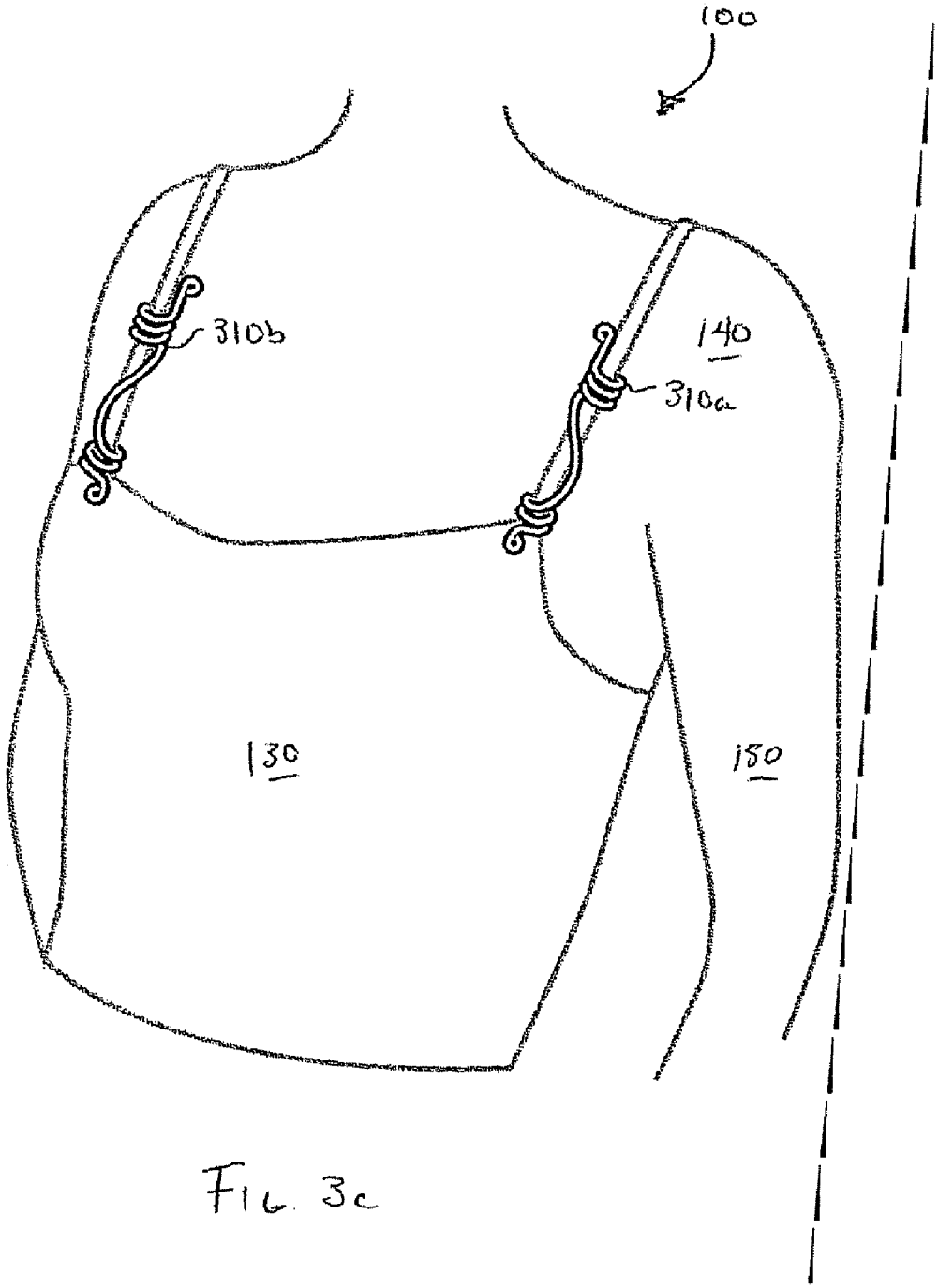

Deploying securing devices 310 includes weaving bra strap 110 and blouse strap 120 over and past opposing, weavable element 360, under and past opposing weavable element 362, over and past opposing, weavable element 364, under and past opposing, weavable element 366, over and past opposing, weavable element 368, and under and past opposing, weavable element 370. Further, bra strap 110 and blouse strap 120 are weaved over and past opposing, weavable element 372, under and past opposing, weavable element 374, and over and past opposing, weavable element 376. Upon doing such, both of the straps become integrated with securing devices 310. FIG. 3C shows securing devices 310 deployed in relation to a person 100 wearing blouse 130.

Figure 4B:
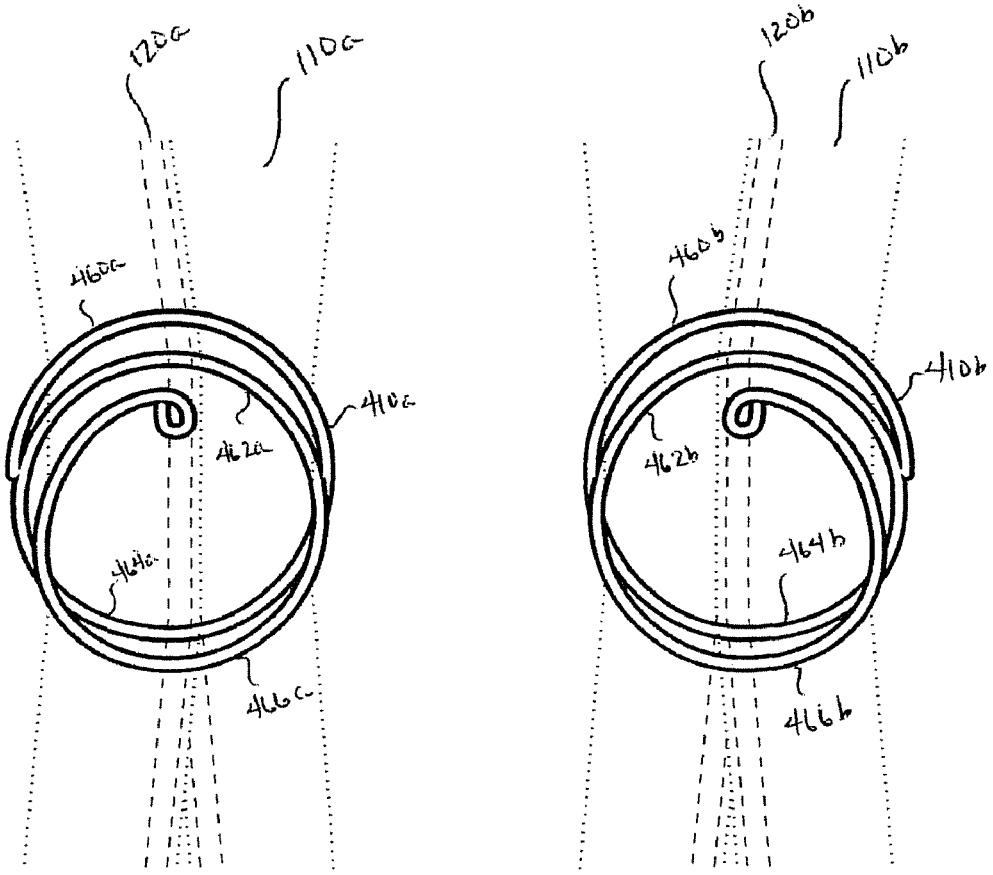
FIG. 4A-4C depict circular securing devices in accordance with various embodiments of the present invention.
Figure 4A:
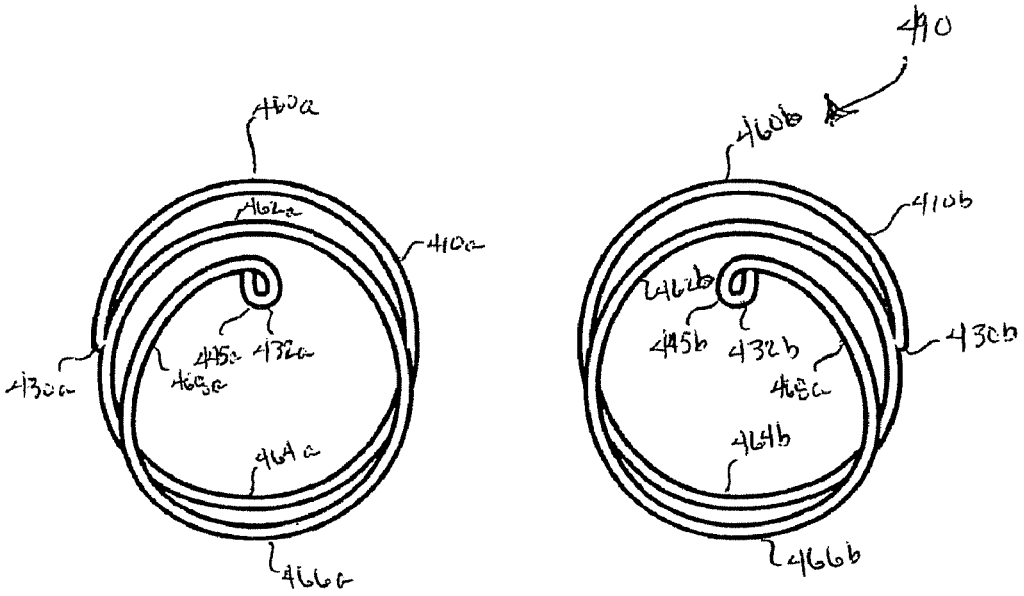

Turning to FIG. 4A, a securing device kit 490 including a pair of circular securing devices 410 in accordance with one or more embodiments of the present invention is shown. Each securing device 410 is made of a long, thin material that is formed into a number of offset substantially circular shapes. The long, thin material may be, but is not limited to, metal wire, plastic, vinyl coated metal wire, enamel coated metal wire, or rubber coated metal wire. Again, based on the disclosure provided herein, one of ordinary skill in the art will recognize a variety of long, thin materials that may be used in accordance with one or more embodiments of the present invention.

As shown, the long, thin material includes two ends 430, 432 and is formed into a coil with what appears to be overlayed circles comprising a number of opposing, weavable elements. In particular, securing device 410 includes opposing, weavable elements 460, 462, 464, 466, 468. End 432 is formed to include an eyelet 445 and end 430 is laid in contact with another portion of the long, thin material. Such bending renders a potentially sharp end of securing device 410 from sticking a user of the device and also provides for an eyelet to which an adornment (not shown) may be attached.

In one particular embodiment of the present invention, securing devices 410 are created by taking a length of metal wire and bending it into the shown form to create the opposing, weavable elements. In some cases, the wire is a copper wire having a width between wire gauge fourteen and eighteen. In one particular case, an enamel covered copper wire of wire gauge sixteen is used. Such a width provides substantial sturdiness, while maintaining a reasonable weight and slenderness for the securing device. In some other cases sterling silver or gold filled metal wire with a width between wire gauge fourteen and eighteen is used. In one particular case, a sterling silver wire of wire gauge sixteen is used, while in another particular case a gold filled wire of wire gauge sixteen is used. In other embodiments of the present invention, securing devices 410 are created by molding a continuous plastic piece that has a shape defined by the depicted opposing, weavable elements. Based on the disclosure provided herein, one of ordinary skill in the art will recognize a variety of manufacturing methods and materials that may be employed to create securing devices 410 in accordance with various embodiments of the present invention.

As shown in FIG. 4B, securing devices 410 may be used to secure blouse strap 120 associated with a blouse to an underlying bra strap 110. Of note, bra strap 110 and blouse strap 120 are shown with dashed lines. Opposing, weavable elements 460, 462, 464, 466, 468 alternate going over and under the secured clothing. In particular, opposing, weavable element 460 extends over bra strap 110 and blouse strap 120 and the next opposing, weavable element 462 extends behind bra strap 110 and blouse strap 120. As shown, this alternating pattern is repeated for adjacent opposing, weavable elements 464, 466, 468. By alternating as shown, bra strap 110 and blouse strap 120 are secured together by securing devices 410.

Figure 4C:
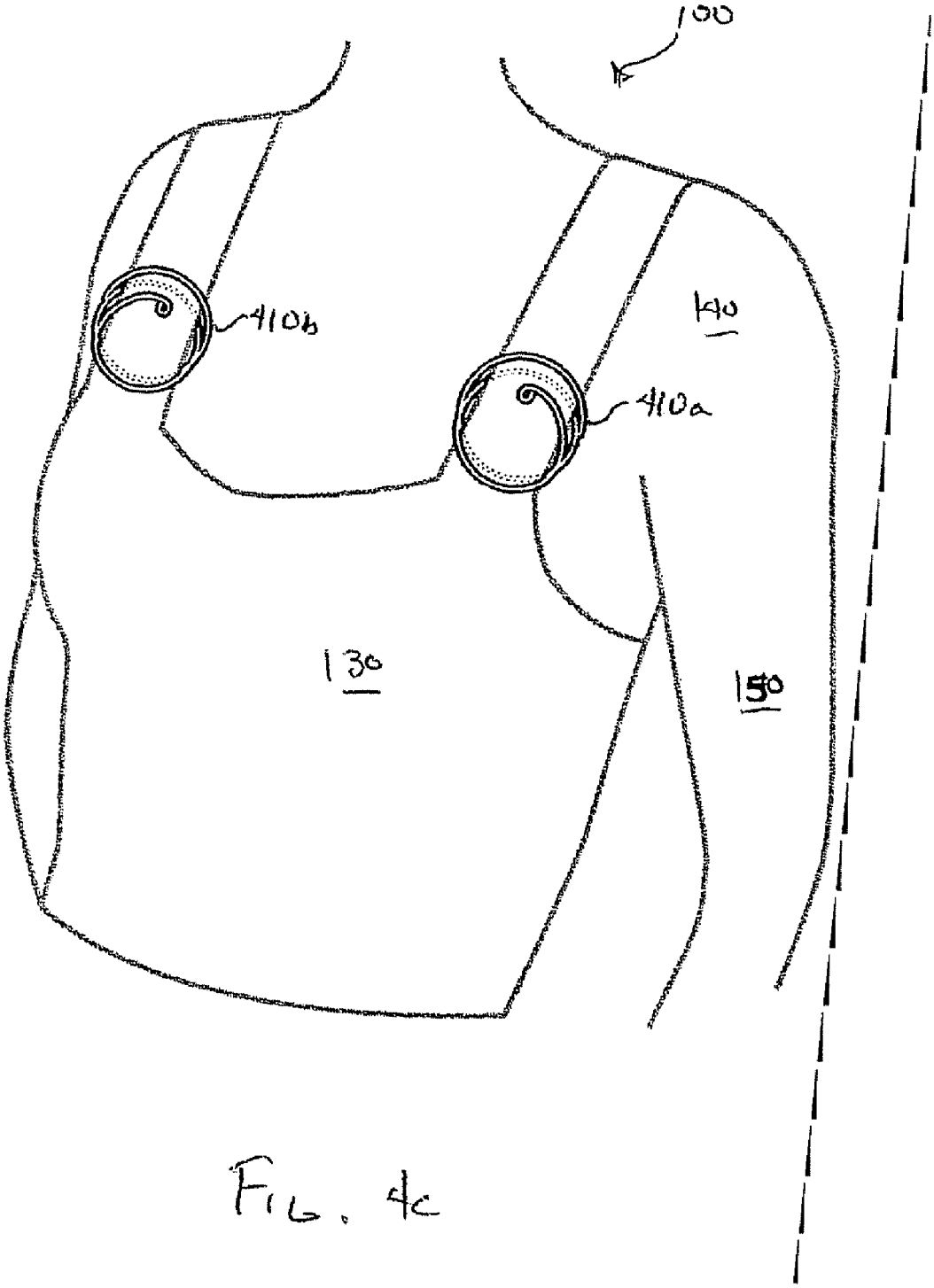

Deploying securing devices 410 includes weaving bra strap 110 and blouse strap 120 under and past opposing, weavable element 460, over and past opposing weavable element 462, under and past opposing, weavable element 464, over and past opposing, weavable element 466, and under and past opposing, weavable element 468. Upon doing such, both of the straps become integrated with securing devices 410. FIG. 4*c* shows securing devices 410 deployed in relation to a person 100 wearing blouse 130.

Figure 5B:
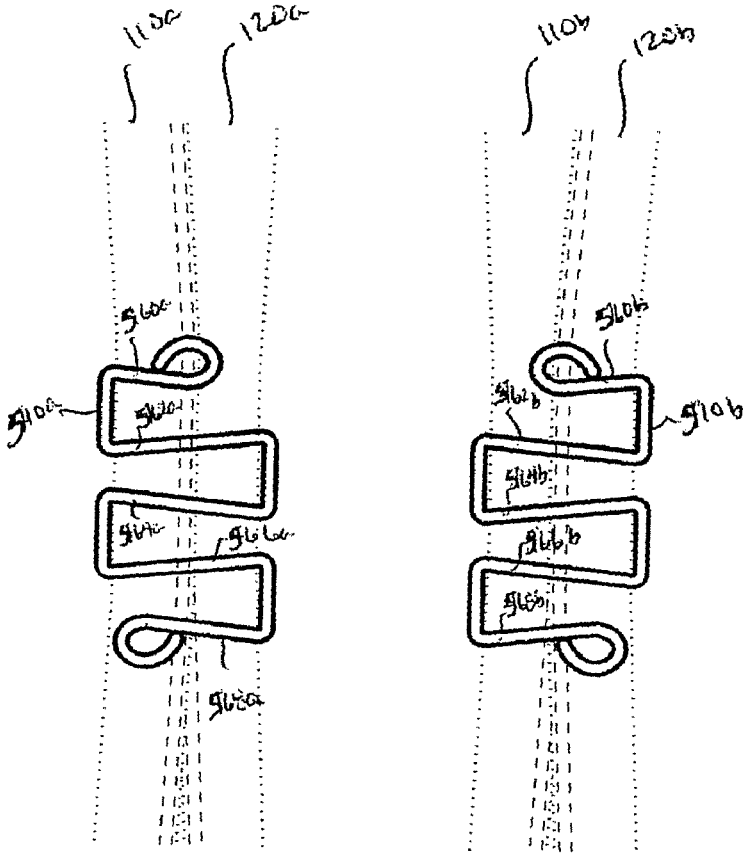
FIGS. 5A-5C depict square securing devices in accordance with other embodiments of the present invention.
Figure 5A:
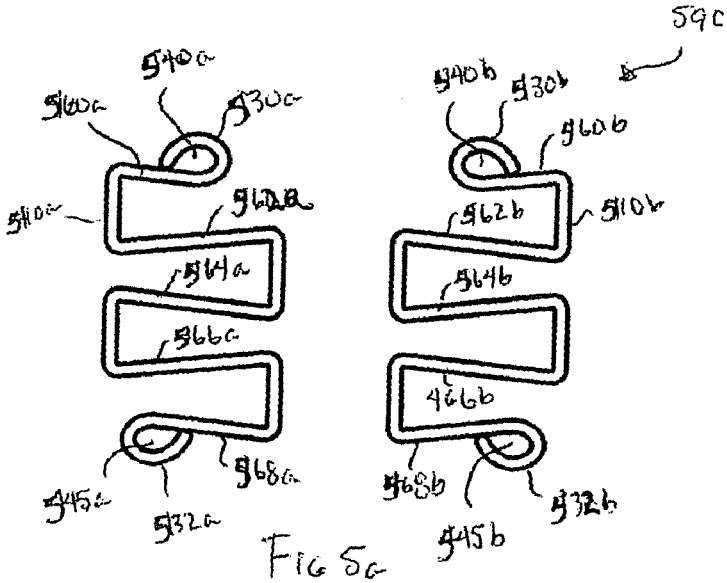

Turning to FIG. 5A, a securing device kit 590 including a pair of square securing devices 510 in accordance with other embodiments of the present invention. Each of square securing devices 510 is made of a long, thin material that is formed into a zig-zag pattern substantially, where the pattern is substantially flat (i.e., lying in the same plane). The long, thin material may be, but is not limited to, metal wire, plastic, vinyl coated metal wire, enamel coated metal wire, or rubber coated metal wire. Again, based on the disclosure provided herein, one of ordinary skill in the art will recognize a variety of long, thin materials that may be used in accordance with one or more embodiments of the present invention.

As shown, the long, thin material includes two ends 530, 532 and is formed into a zig-zag pattern comprising a number of opposing, weavable elements. In particular, securing device 510 includes opposing, weavable elements 560, 562, 564, 566, 568. End 532 is formed to include an eyelet 545 and end 530 formed to include an eyelet 540. Such bending renders a potentially sharp end of securing device 510 from sticking a user of the device and also provides for eyelets to which an adornment (not shown) may be attached.

In one particular embodiment of the present invention, securing devices 510 are created by taking a length of metal wire and bending it into the shown form to create the opposing, weavable elements. In some cases, the wire is a copper wire having a width between wire gauge fourteen and eighteen. In one particular case, an enamel covered copper wire of wire gauge sixteen is used. Such a width provides substantial sturdiness, while maintaining a reasonable weight and slenderness for the securing device. In some other cases, sterling silver or gold filled metal wire with a width between wire gauge fourteen and eighteen is used. In one particular case, a sterling silver wire of wire gauge sixteen is used, while in another particular case a gold filled wire of wire gauge sixteen is used. In other embodiments of the present invention, securing devices 510 are created by molding a continuous plastic piece that has a shape defined by the depicted opposing, weavable elements. Based on the disclosure provided herein, one of ordinary skill in the art will recognize a variety of manufacturing methods and materials that may be employed to create securing devices 510 in accordance with various embodiments of the present invention.

As shown in FIG. 5B, securing devices 510 may be used to secure blouse strap 120 associated with a blouse to an underlying bra strap 110. Of note, bra strap 110 and blouse strap 120 are shown with dashed lines. Opposing, weavable elements 560, 562, 564, 566, 568 alternate going over and under the secured clothing. In particular, opposing, weavable element 560 extends over bra strap 110 and blouse strap 120, and the next opposing, weavable element 562 extends behind bra strap 110 and blouse strap 120. As shown, this alternating pattern is repeated for adjacent opposing, weavable elements 564, 566, 568. By alternating as shown, bra strap 110 and blouse strap 120 are secured together by securing devices 510.

Figure 5C:
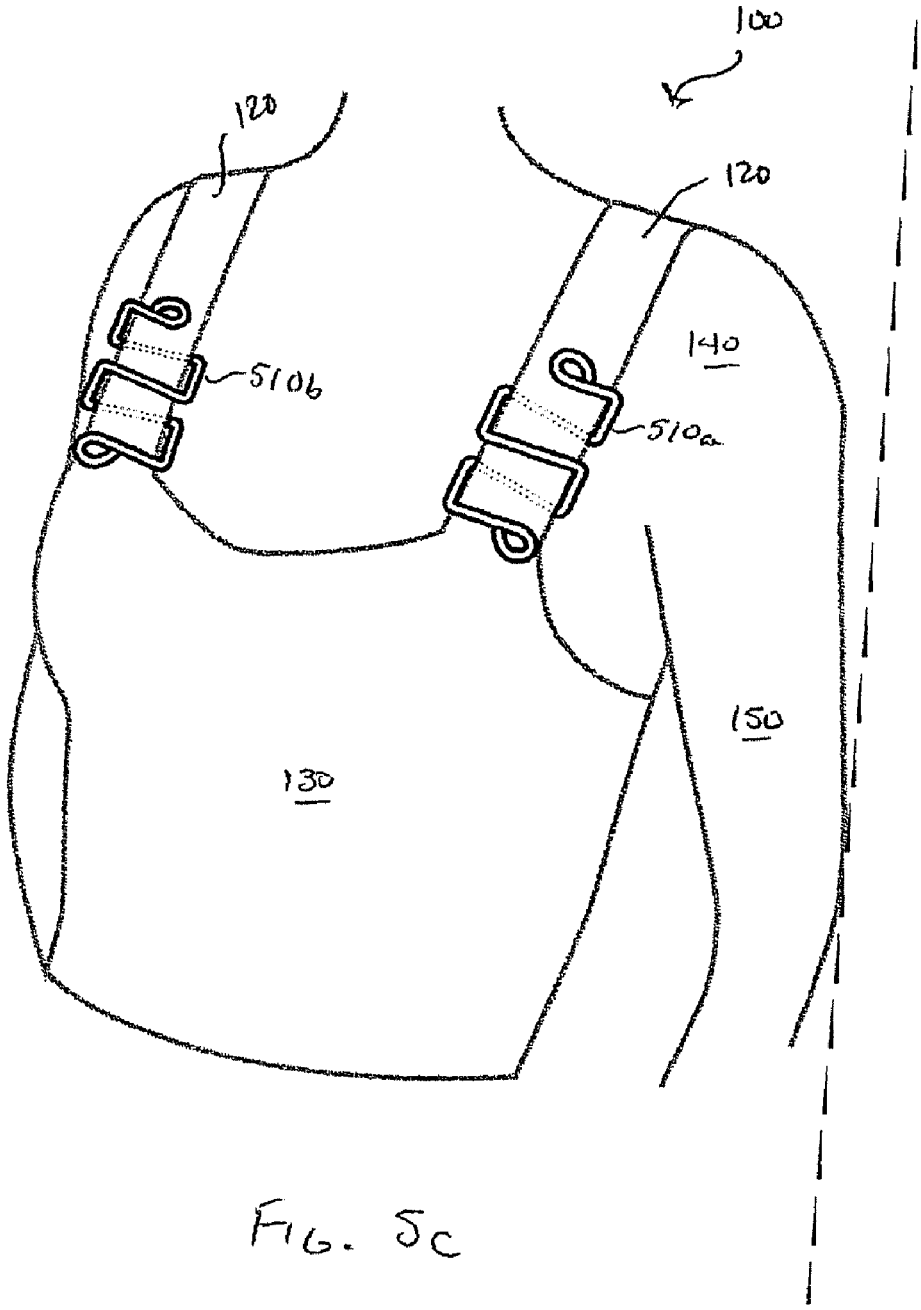

Deploying securing devices 510 includes weaving bra strap 110 and blouse strap 120 under and past opposing, weavable element 560, over and past opposing weavable element 562, under and past opposing, weavable element 564, over and past opposing, weavable element 566, and under and past opposing, weavable element 568. Upon doing such, both of the straps become integrated with securing devices 510. FIG. 5C shows securing devices 510 deployed in relation to a person 100 wearing blouse 130.

In another aspect, the present invention provides a clothing securing kit.

In one embodiment, the clothing securing kit includes:

a securing device, wherein the securing device includes:

a long, thin material, wherein the long, thin material has a first end and a second end with a body extending between the first end and the second end, and wherein the long, thin material is formed into a plurality of opposing, weavable elements, wherein a first of the plurality of opposing weavable elements is continuous with a first end of a second of the plurality of the opposing, weavable elements at a first junction, wherein a first end of the third of the plurality of opposing, weavable elements is continuous with a second end of the second of the plurality of the opposing, weavable elements at a second junction, wherein a fourth of the plurality of opposing, weavable elements is continuous with a second end of the third of the plurality of the opposing, weavable elements at a third junction; and wherein the first end is associated with an attachment point; and a detachable adornment, wherein the detachable adornment is operable to attach and detach from the attachment point.

In one or more cases, the clothing securing kit may include a securing device and one or more adornments. Further, in some cases, the kit may include instructions for installing and using the securing device.

In one embodiment, the kit may further include a second securing device substantially similar to the first securing device, and a second adornment.

Figure 6B:
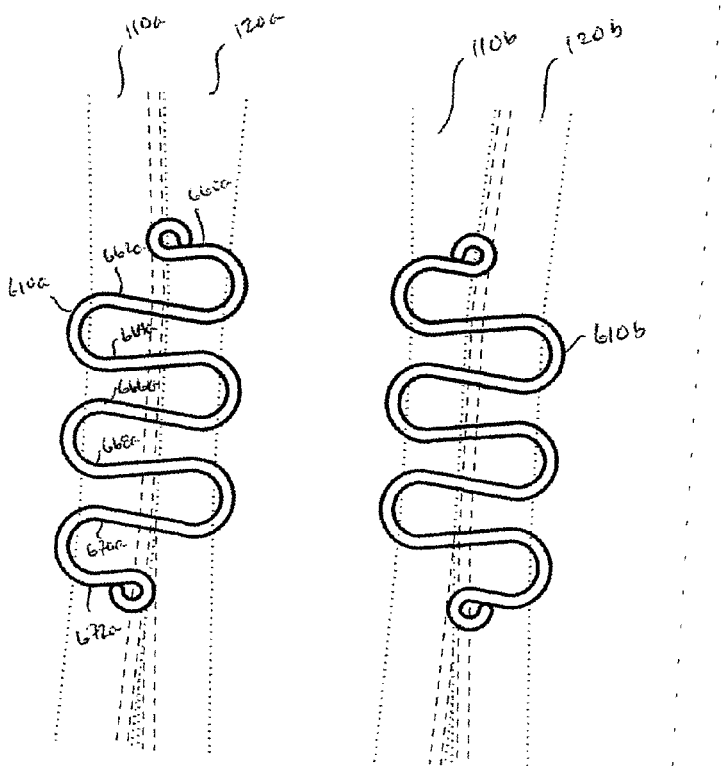
FIGS. 6A-6C depict serpentine securing devices in accordance with some embodiments of the present invention.
Figure 6A:
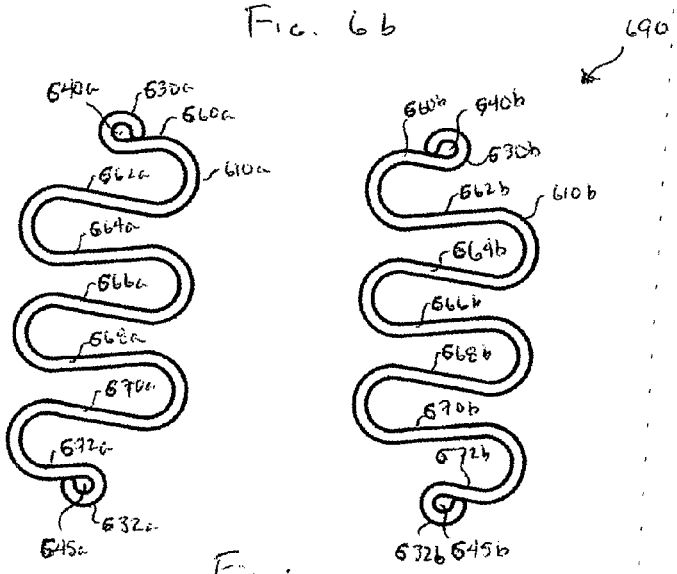

Turning to FIG. 6A, a securing device kit 690 including a pair of serpentine securing devices 610 in accordance with other embodiments of the present invention. Each of serpentine securing devices 610 is made of a long, thin material that is formed into a serpentine pattern where the pattern is substantially flat (i.e., lies in the same plane). The long, thin material may be, but is not limited to, metal wire, plastic, vinyl coated metal wire, enamel coated metal wire, or rubber coated metal wire. Again, based on the disclosure provided herein, one of ordinary skill in the art will recognize a variety of long, thin materials that may be used in accordance with one or more embodiments of the present invention.

As shown, the long, thin material includes two ends 630, 632 and is formed into a serpentine pattern comprising a number of opposing, weavable elements. In particular, securing device 610 includes opposing, weavable elements 660, 662, 664, 666, 668, 670, 672. End 632 is formed to include an eyelet 645 and end 630 formed to include an eyelet 640. Such bending renders a potentially sharp end of securing device 610 from sticking a user of the device and also provides for eyelets to which an adornment (not shown) may be attached.

In one particular embodiment of the present invention, securing devices 610 are created by taking a length of metal wire and bending it into the shown form to create the opposing, weavable elements. In some cases, the wire is a copper wire having a width between wire gauge fourteen and eighteen. In one particular case, an enamel covered copper wire of wire gauge sixteen is used. Such a width provides substantial sturdiness, while maintaining a reasonable weight and slenderness for the securing device. In some other cases sterling silver or gold filled metal wire with a width between wire gauge fourteen and eighteen is used. In one particular case, a sterling silver wire of wire gauge sixteen is used, while in another particular case a gold filled wire of wire gauge sixteen is used. In other embodiments of the present invention, securing devices 610 are created by molding a continuous plastic piece that has a shape defined by the depicted opposing, weavable elements. Based on the disclosure provided herein, one of ordinary skill in the art will recognize a variety of manufacturing methods and materials that may be employed to create securing devices 610 in accordance with various embodiments of the present invention.

As shown in FIG. 6B, securing devices 610 may be used to secure blouse strap 120 associated with a blouse to an underlying bra strap 110. Of note, bra strap 110 and blouse strap 120 are shown with dashed lines. Opposing, weavable elements 660, 662, 664, 666, 668, 670, 672 alternate going over and under the secured clothing. In particular, opposing, weavable element 660 extends over bra strap 110 and blouse strap 120, and the next opposing, weavable element 662 extends behind bra strap 110 and blouse strap 120. As shown, this alternating pattern is repeated for adjacent opposing, weavable elements 664, 666, 668, 670, 672. By alternating as shown, bra strap 110 and blouse strap 120 are secured together by securing devices 610.

Figure 6C:
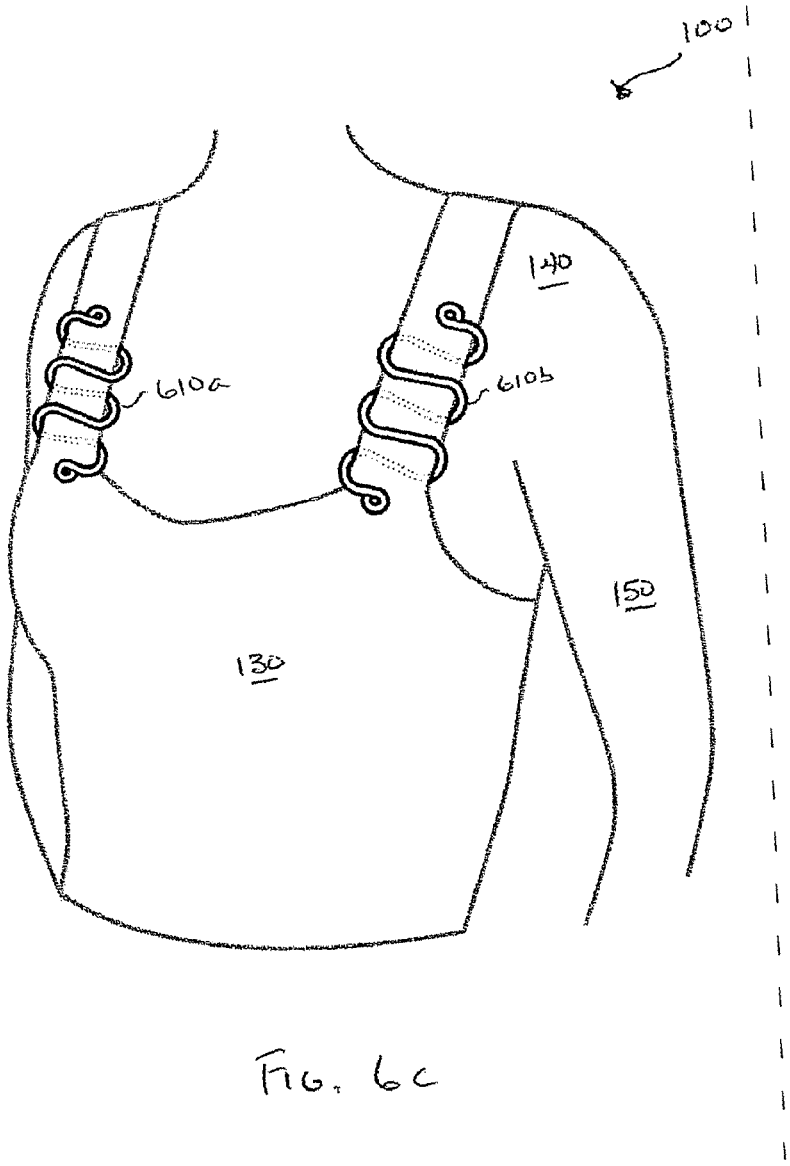

Deploying securing devices 610 includes weaving bra strap 110 and blouse strap 120 under and past opposing, weavable element 660, over and past opposing weavable element 662, under and past opposing, weavable element 664, over and past opposing, weavable element 666, under and past opposing, weavable element 668, over and past opposing, weavable element 670, and under and past opposing, weavable element 672. Upon doing such, both of the straps become integrated with securing devices 610. FIG. 6C shows securing devices 610 deployed in relation to a person 100 wearing blouse 130.

Figure 7B:
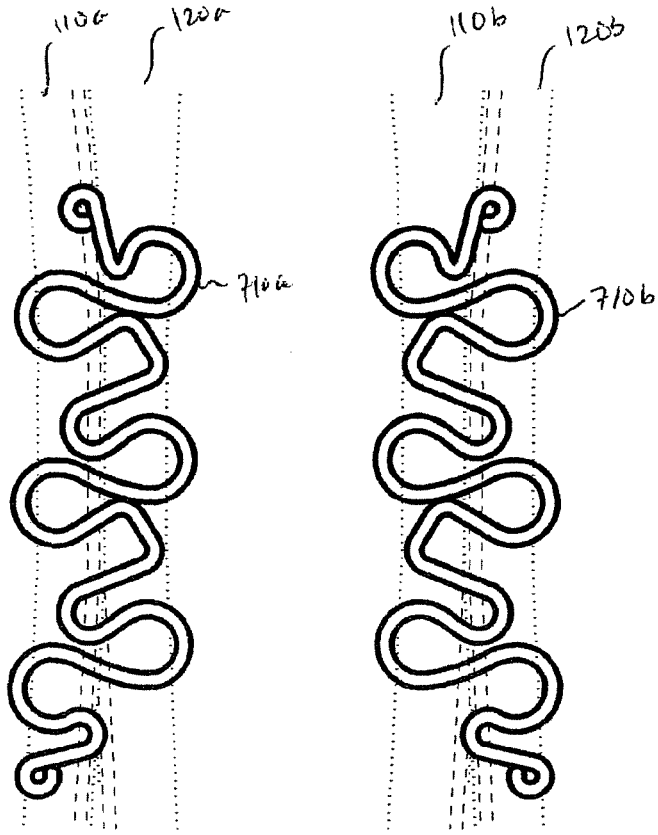
FIGS. 7A-7C depict irregular shaped securing devices in accordance with various embodiments of the present invention.
Figure 7A:
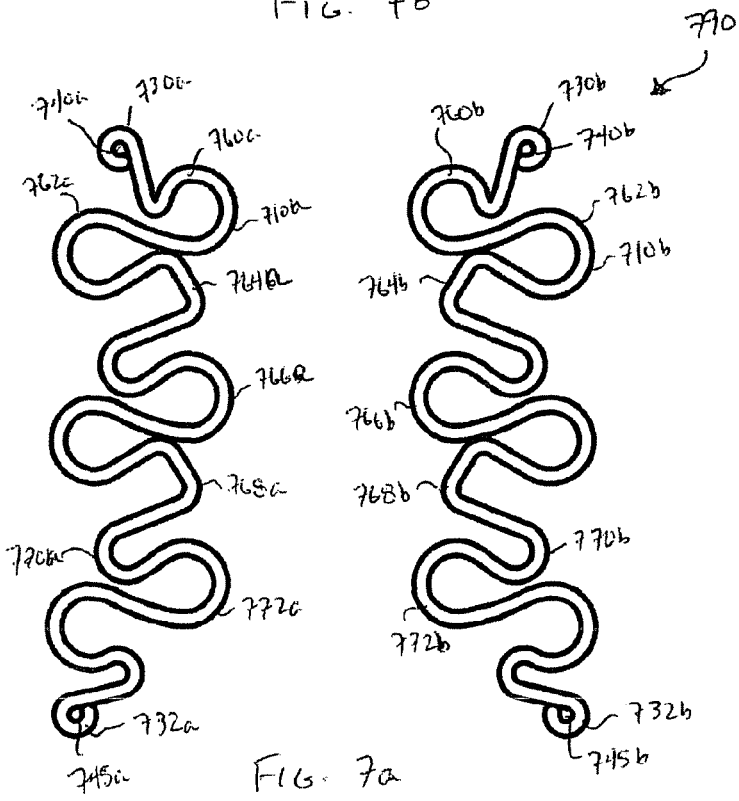

Turning to FIG. 7A, a securing device kit 790 including a pair of irregular shaped securing devices 710 in accordance with other embodiments of the present invention is shown. Each of irregular shaped securing devices 710 is made of a long, thin material that is formed into a serpentine pattern where the pattern is substantially flat (i.e., lies in the same plane). The long, thin material may be, but is not limited to, metal wire, plastic, vinyl coated metal wire, enamel coated metal wire, or rubber coated metal wire. Again, based on the disclosure provided herein, one of ordinary skill in the art will recognize a variety of long, thin materials that may be used in accordance with one or more embodiments of the present invention.

As shown, the long, thin material includes two ends 730, 732 and is formed into an irregular pattern comprising a number of opposing, weavable elements. In particular, securing device 710 includes opposing, weavable elements 760, 762, 764, 766, 768, 770, 772. End 732 is formed to include an eyelet 745 and end 730 formed to include an eyelet 740. Such bending renders a potentially sharp end of securing device 710 from sticking a user of the device and also provides for eyelets to which an adornment (not shown) may be attached.

In one particular embodiment of the present invention, securing devices 710 are created by taking a length of metal wire and bending it into the shown form to create the opposing, weavable elements. In some cases, the wire is a copper wire having a width between wire gauge fourteen and eighteen. In one particular case, an enamel covered copper wire of wire gauge sixteen is used. Such a width provides substantial sturdiness, while maintaining a reasonable weight and slenderness for the securing device. In some other cases sterling silver or gold filled metal wire with a width between wire gauge fourteen and eighteen is used. In one particular case, a sterling silver wire of wire gauge sixteen is used, while in another particular case a gold filled wire of wire gauge sixteen is used. In other embodiments of the present invention, securing devices 710 are created by molding a continuous plastic piece that has a shape defined by the depicted opposing, weavable elements. Based on the disclosure provided herein, one of ordinary skill in the art will recognize a variety of manufacturing methods and materials that may be employed to create securing devices 710 in accordance with various embodiments of the present invention.

As shown in FIG. 7B, securing devices 710 may be used to secure blouse strap 120 associated with a blouse to an underlying bra strap 110. Of note, bra strap 110 and blouse strap 120 are shown with dashed lines. Opposing, weavable elements 760, 762, 764, 766, 768, 770, 772 alternate going over and under the secured clothing. In particular, opposing, weavable element 760 extends behind bra strap 110 and blouse strap 120 and the next opposing, weavable element 762 extends over bra strap 110 and blouse strap 120. As shown, this alternating pattern is repeated for adjacent opposing, weavable elements 764, 766, 768, 770, 772. By alternating as shown, bra strap 110 and blouse strap 120 are secured together by securing devices 710.

Figure 7C:
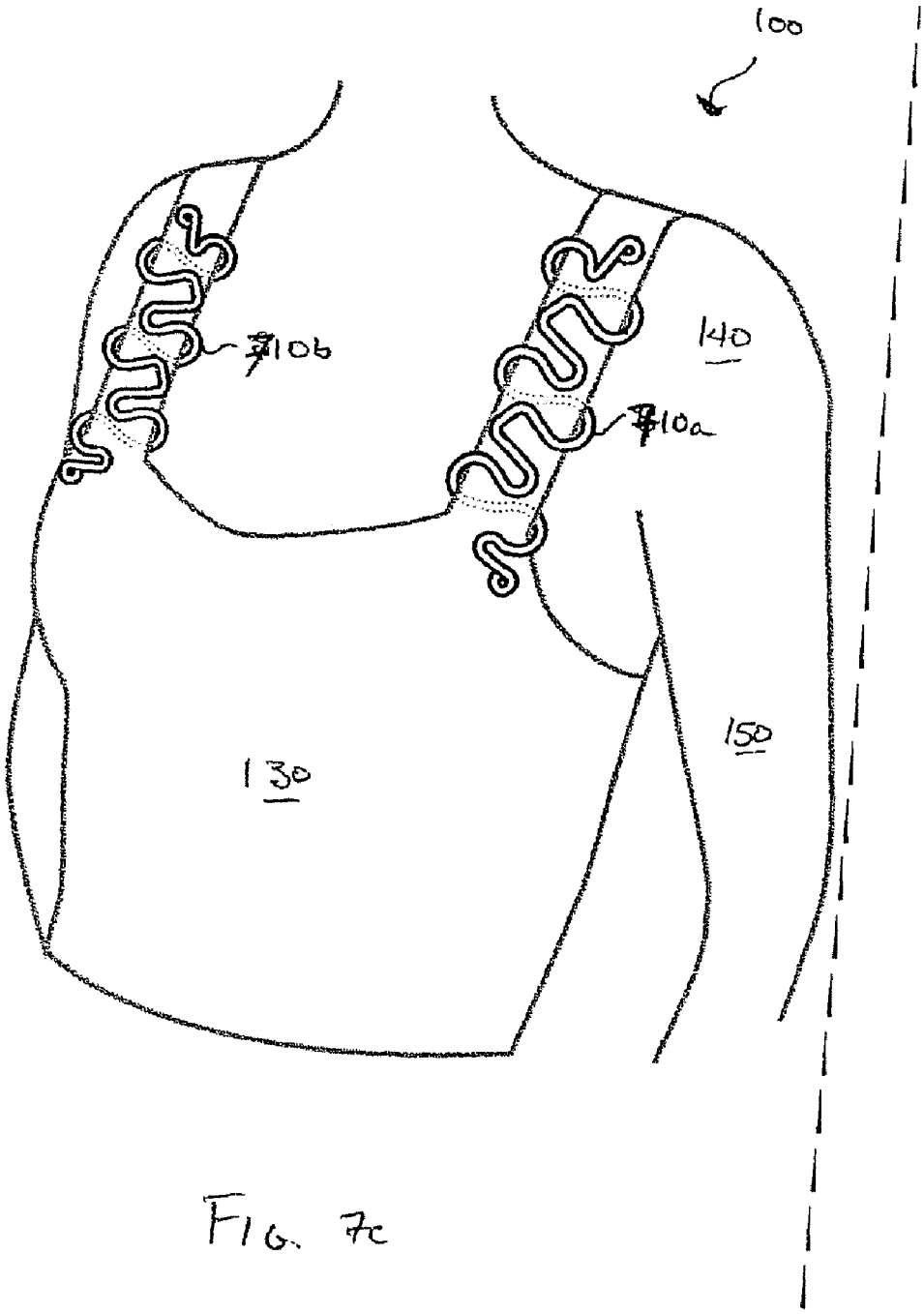

Deploying securing devices 710 includes weaving bra strap 110 and blouse strap 120 under and past opposing, weavable element 760, over and past opposing weavable element 762, under and past opposing, weavable element 764, over and past opposing, weavable element 766, under and past opposing, weavable element 768, over and past opposing, weavable element 770, and under and past opposing, weavable element 772. Upon doing such, both of the straps become integrated with securing devices 710. FIG. 7C shows securing devices 710 deployed in relation to a person 100 wearing blouse 130.

Figure 8B:
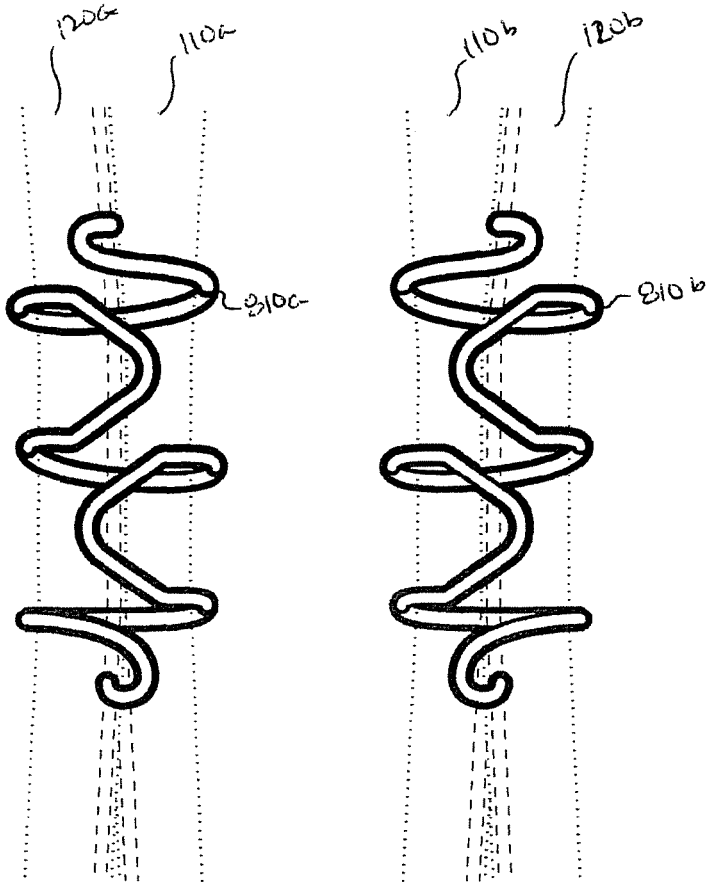
FIGS. 8A-8C depict dual plane securing devices in accordance with one or more embodiments of the present invention.
Figure 8A:
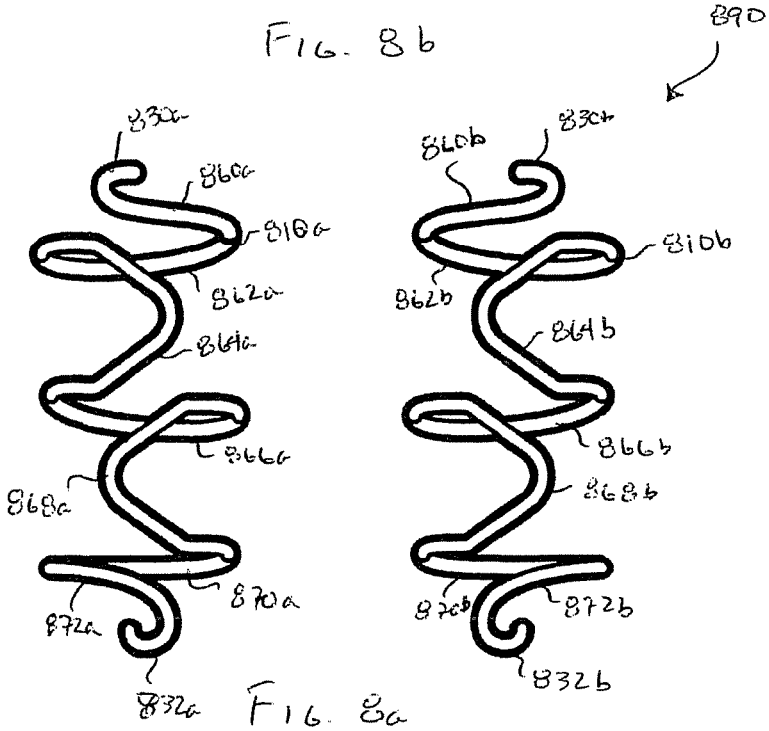

Turning to FIG. 8A, a securing device kit 890 including a pair of dual plane securing devices 810 in accordance with other embodiments of the present invention. Each of dual plane securing devices 810 is made of a long, thin material that is formed into a serpentine pattern where the pattern is substantially flat (i.e., lies in the same plane). The long, thin material may be, but is not limited to, metal wire, plastic, vinyl coated metal wire, enamel coated metal wire, or rubber coated metal wire. Again, based on the disclosure provided herein, one of ordinary skill in the art will recognize a variety of long, thin materials that may be used in accordance with one or more embodiments of the present invention.

As shown, the long, thin material includes two ends 830, 832 and is formed into an irregular pattern comprising a number of opposing, weavable elements. In particular, securing device 810 includes opposing, weavable elements 860, 862, 864, 866, 868, 870, 872. In one particular embodiment of the present invention, securing devices 810 are created by taking a length of metal wire and bending it into the shown form to create the opposing, weavable elements. In some cases, the wire is a copper wire having a width between wire gauge fourteen and eighteen. In one particular case, an enamel covered copper wire of wire gauge sixteen is used. Such a width provides substantial sturdiness, while maintaining a reasonable weight and slenderness for the securing device. In some other cases sterling silver or gold filled metal wire with a width between wire gauge fourteen and eighteen is used. In one particular case, a sterling silver wire of wire gauge sixteen is used, while in another particular case a gold filled wire of wire gauge sixteen is used. In other embodiments of the present invention, securing devices 810 are created by molding a continuous plastic piece that has a shape defined by the depicted opposing, weavable elements. Based on the disclosure provided herein, one of ordinary skill in the art will recognize a variety of manufacturing methods and materials that may be employed to create securing devices 810 in accordance with various embodiments of the present invention.

As shown in FIG. 8B, securing devices 810 may be used to secure blouse strap 120 associated with a blouse to an underlying bra strap 110. Of note, bra strap 110 and blouse strap 120 are shown with dashed lines. Opposing, weavable elements 860, 862, 864, 866, 868, 870, 872 alternate going over and under the secured clothing. Securing device 810 is referred to as a dual plane because opposing, weavable elements 860, 864, 868, 872 lay substantially along one plane, while opposing, weavable elements 862, 866, 870 lay substantially along another plane. The adjacent opposing, weavable elements are connected by portions of the long, thin material extending between the planes. When installed, opposing, weavable element 860 extends over bra strap 110 and blouse strap 120, and the next opposing, weavable element 862 extends behind bra strap 110 and blouse strap 120. As shown, this alternating pattern is repeated for adjacent opposing, weavable elements 864, 866, 868, 870, 872. By alternating as shown, bra strap 110 and blouse strap 120 are secured together by securing devices 810.

Figure 8C:
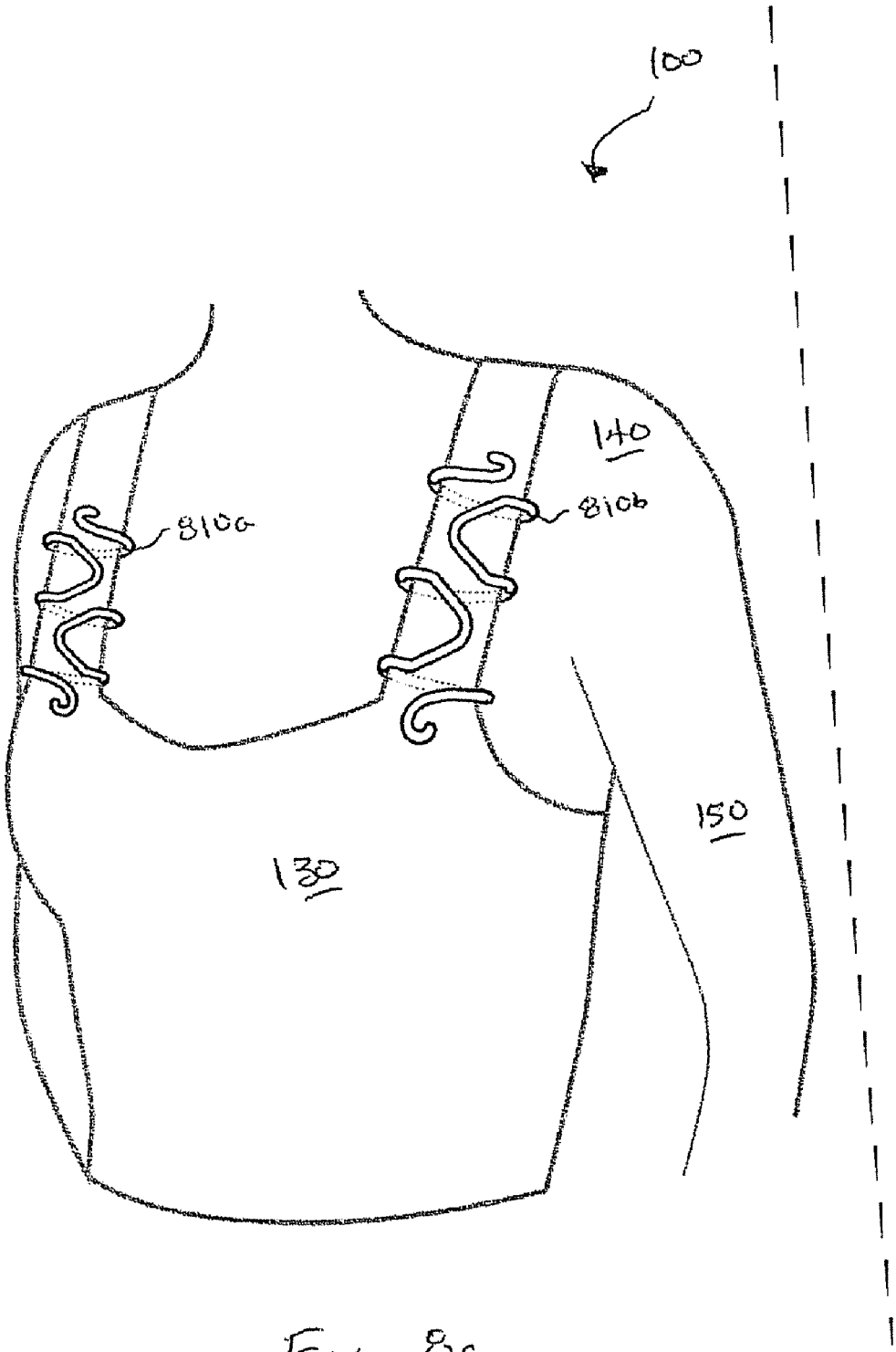

Deploying securing devices 810 includes weaving bra strap 110 and blouse strap 120 under and past opposing, weavable element 860, over and past opposing weavable element 862, under and past opposing, weavable element 864, over and past opposing, weavable element 866, under and past opposing, weavable element 868, over and past opposing, weavable element 870, and under and past opposing, weavable element 872. Upon doing such, both of the straps become integrated with securing devices 810. FIG. 8C shows securing devices 810 deployed in relation to a person 100 wearing blouse 130.

Figure 9B:
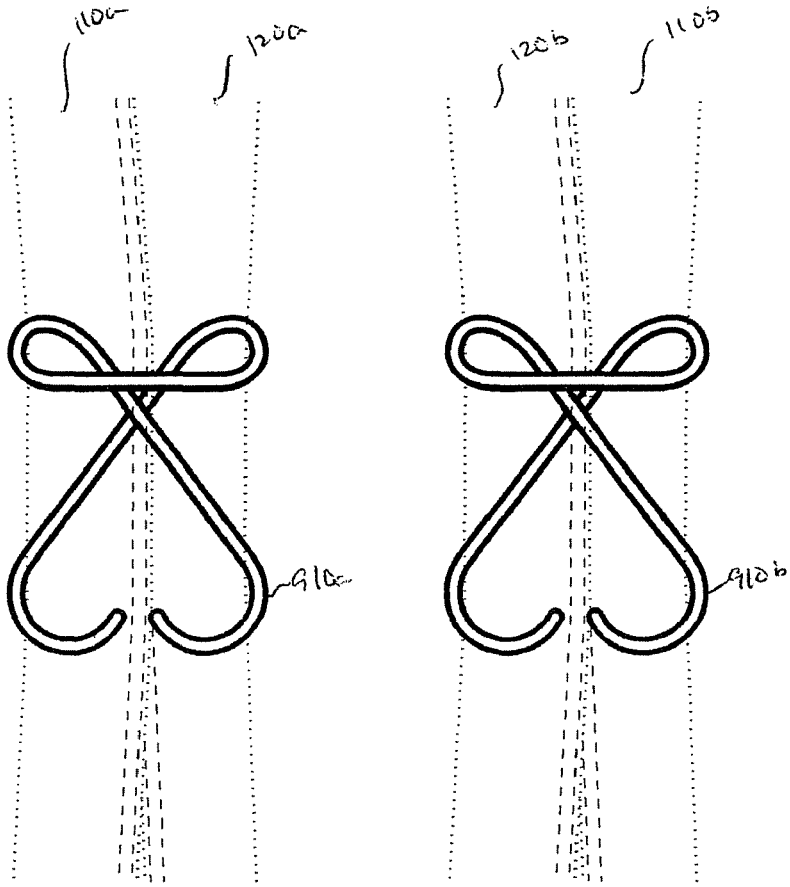
FIG. 9A-9C depict bow shaped securing devices in accordance with some embodiments of the present invention.
Figure 9A:
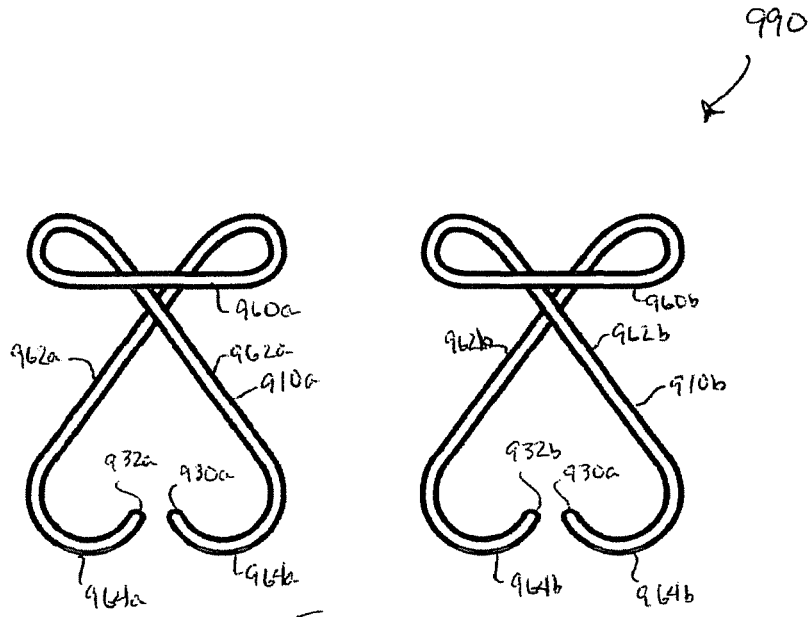

Turning to FIG. 9A, a securing device kit 990 including a pair of bow shaped securing devices 910 in accordance with other embodiments of the present invention is shown. Each of bow shaped securing devices 910 is made of a long, thin material that is formed into a serpentine pattern where the pattern is substantially flat (i.e., lies in the same plane). The long, thin material may be, but is not limited to, metal wire, plastic, vinyl coated metal wire, enamel coated metal wire, or rubber coated metal wire. Again, based on the disclosure provided herein, one of ordinary skill in the art will recognize a variety of long, thin materials that may be used in accordance with one or more embodiments of the present invention.

As shown, the long, thin material includes two ends 930, 932 and is formed into an irregular pattern comprising a number of opposing, weavable elements. In particular, securing device 910 includes opposing, weavable elements 960, 962, 964. In one particular embodiment of the present invention, securing devices 910 are created by taking a length of metal wire and bending it into the shown form to create the opposing, weavable elements. In some cases, the wire is a copper wire having a width between wire gauge fourteen and eighteen. In one particular case, an enamel covered copper wire of wire gauge sixteen is used. Such a width provides substantial sturdiness, while maintaining a reasonable weight and slenderness for the securing device. In some other cases sterling silver or gold filled metal wire with a width between wire gauge fourteen and eighteen is used. In one particular case, a sterling silver wire of wire gauge sixteen is used, while in another particular case a gold filled wire of wire gauge sixteen is used. In other embodiments of the present invention, securing devices 810 are created by molding a continuous plastic piece that has a shape defined by the depicted opposing, weavable elements. Based on the disclosure provided herein, one of ordinary skill in the art will recognize a variety of manufacturing methods and materials that may be employed to create securing devices 810 in accordance with various embodiments of the present invention.

Figure 9C:
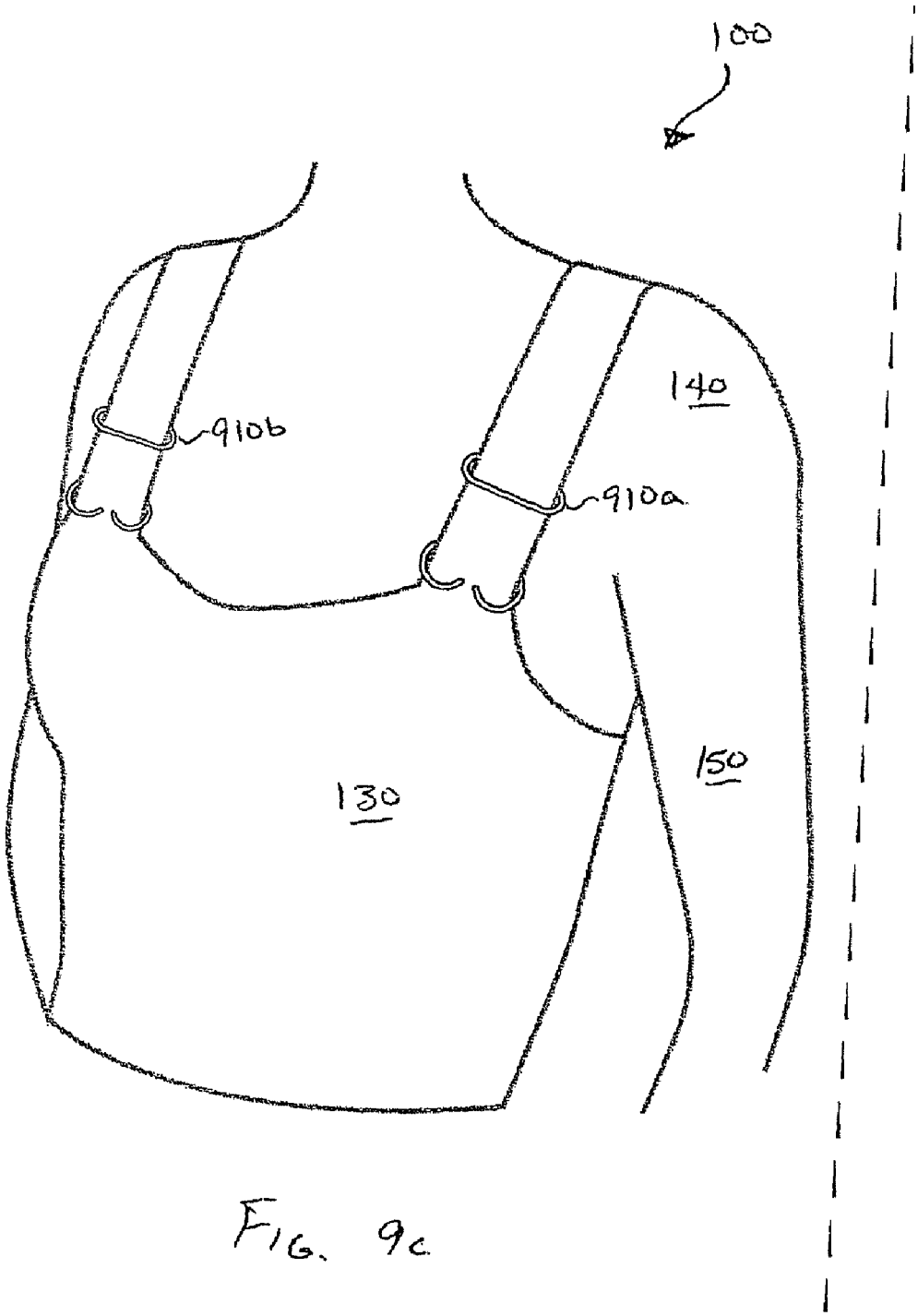

As shown in FIG. 9B, securing devices 910 may be used to secure blouse strap 120 associated with a blouse to an underlying bra strap 110. Of note, bra strap 110 and blouse strap 120 are shown with dashed lines. Opposing, weavable elements 960, 962, 964. As shown, opposing, weavable element 962 is formed by the combination of two different portions of the long, thin material, as is opposing, weavable element 964. When installed, opposing, weavable element 960 extends over bra strap 110 and blouse strap 120, the next opposing, weavable element 962 extends behind bra strap 110 and blouse strap 120, and opposing, weavable element 964 extends over bra strap 110 and blouse strap 120. By alternating as shown, bra strap 110 and blouse strap 120 are secured together by securing devices 910. Deploying securing devices 910 includes weaving bra strap 110 and blouse strap 120 under and past opposing, weavable element 960, over and past opposing weavable element 962, and under and past opposing, weavable element 964. FIG. 9C shows securing devices 910 deployed in relation to a person 100 wearing blouse 130.

In another aspect, the present invention provides methods for securing clothing, in particular, for securing a bra strap to a blouse strap.

In one embodiment, the method comprises the steps of:

providing a securing device, wherein the securing device includes a long, thin material, wherein the long, thin material has a first end and a second end with a body extending between the first end and the second end, and wherein the long, thin material is formed into a plurality of opposing, weavable elements, wherein a first of the plurality of opposing weavable elements is continuous with a first end of a second of the plurality of the opposing, weavable elements at a first junction, wherein a first end of the third of the plurality of opposing, weavable elements is continuous with a second end of the second of the plurality of the opposing, weavable elements at a second junction, and wherein a fourth of the plurality of opposing, weavable elements is continuous with a second end of the third of the plurality of the opposing, weavable elements at a third junction;

placing at least two straps together to form a strap group; and performing a weave, wherein the strap group is fed past the first of the opposing, weavable elements, passed past the second of the opposing weavable elements, passed past the third of the opposing, weavable elements, and passed past the fourth of the opposing, weavable elements; wherein the first junction encases the strap group at one side of the strap group, and wherein the second junction encases the strap group at an opposite side of the strap group.

In the methods, feeding the strap group passed the first of the opposing, weavable elements can include going over the first of the opposing, weavable elements; feeding the strap group past the second of the opposing, weavable elements can include going under the second of the opposing, weavable elements; feeding the strap group past the third of the opposing, weavable elements can include going over the third of the opposing, weavable elements; and feeding the strap group past the fourth of the opposing, weavable elements can include going under the fourth of the opposing, weavable elements.

In one embodiment, feeding the strap group past the first, second and third of the opposing, weavable elements includes passing the strap group between and under the first and third of the opposing, weavable elements and over the second of the opposing weavable elements.

In another aspect, the present invention provides methods for decorating clothing.

In one embodiment, the method comprises:

providing a device, wherein the device includes a long, thin material, wherein the long, thin material has a first end and a second end with a body extending between the first end and the second end, and wherein the long thin material is formed into at least five opposing, weavable elements; and performing a weave, wherein a strap on the clothing is fed passed the first of the opposing, weavable elements, passed the second of the opposing weavable elements, passed the third of the opposing, weavable elements, and passed the fourth of the opposing, weavable elements; wherein the first injunction encases the strap group at one side of the strap group, and wherein the second injunction encase the strap group at an opposite side of the strap group.

The long, thin material could be a variety of colors. The weaving of the long thin material could be a variety of artistic expression. The long, thin material could be made of materials popular in making the jewel, such as gold and silver. A person may choose to wear such as device with the color and weaving complimentary to her outfit by weaving the device onto a strap of her clothing for the decoration purpose.

In one embodiment, the method could further include attaching an adornment to the device. Variety of adornments can be attached to the device of the present invention. In some cases, one or more adornments may be attached to the device for aesthetic purpose. The adornments may be detachable from the device allowing for interchanging such adornments.

In another aspect, the present invention provides devices for decorating clothing.

In one embodiment, the device comprises a long, thin material, wherein the long, thin material has a first end and a second end with a body extending between the first end and the second end, and wherein the long, thin material is formed into at least two opposing, weavable elements.

The long, thin material can be made from metal, plastic, rubber or vinyl.

In one embodiment, the long, thin material is formed such that the first end is associated with an eye, and wherein the eyelet is operable to attach to an adornment.

In one embodiment, the long, thin material is formed into at least five opposing, weavable elements.

In one embodiment, the body of the device includes a first body section, a second body section, and a third body section; wherein the first body section includes at least three of the five opposing, weavable elements; wherein the second body section includes at least two of the opposing, weavable elements, and wherein the third body section is an elongated section extending between the first body section and the second body section. In one embodiment, the long, thin material of the first body section is formed into a first spiral including the at least three of the five opposing, weavable elements, and wherein the long, thin material of the second body section is formed into a second spiral including the at least two of the five opposing, weavable elements. In one embodiment, the long, thin material is formed in a serpentine shape including at least five transverse sections, and wherein the five opposing, weavable elements are respective ones of the five transverse sections of the serpentine shape.

In conclusion, the present invention provides novel systems, devices, methods, and arrangements for securing clothing straps, and for decorating clothing. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

While illustrative embodiments have been illustrated and described, it will be appreciated that various changes can be made therein without departing from the spirit and scope of the invention.

The embodiments of the invention in which an exclusive property or privilege is claimed are defined as follows:

1. A device for securing two or more clothing garment shoulder straps while being worn by a user, comprising:

a length of long, thin material having a first end, a second end, and a body portion extending between the first end and the second end, the long, thin material having at least five opposing, weavable elements constructed and arranged relatively so as to intertwine with at least two adjacent clothing garment shoulder straps and thereby secure them together while being worn, the long, thin material being formed with an eye operable to attach to an adornment adjacent to the secured garment straps while being worn, the size of the length of long, thin material being limited to a size wearable by a user by intertwining with the shoulder straps while being worn.

2. The device of claim 1, in which the eye is formed in the first end of the length of long, thin material.

3. The device of claim 1, wherein the long, thin material is selected from a group consisting of: metal, plastic, rubber and vinyl.

4. The device of claim 1, wherein the long, thin material is a metal wire.

5. The device of claim 1, wherein the body includes a first body end section, a second body end section, and a third body middle section extending between the first and second body end sections; wherein the first body end section includes at least three of the opposing, weavable elements and the second body end section includes at least two of the opposing, weavable elements.

6. The device of claim 5, wherein the long, thin material of the first body end section is formed into a first spiral including the at least three opposing, weavable elements, and wherein the long, thin material of the second body section is formed into a second spiral including the at least two of the opposing, weavable elements.

7. The device of claim 6, including a bead attached to the first body end portion to limit movement of a secured strap.

8. The device of claim 1, wherein the length of long, thin material is formed in a serpentine shape including at least five transverse sections, and wherein the five opposing, weavable elements are respective ones of the five transverse sections of the serpentine shape to intertwine with adjacent garment shoulder straps and secure such straps together.

9. The device of claim 8, including a bead secured at a junction between proximate ones of the transverse sections of the serpentine to limit movement of a secured strap.

10. The device of claim 9, wherein the bead is a first bead, and including a second bead secured adjacent to the first end and wherein the second bead is operable to limit movement of a secured strap.

11. The device of claim 1, wherein the length of long, thin material is formed into at least six opposing, weavable elements, and wherein the at least six opposing weavable elements are grouped into a first set of at least three opposing, weavable elements and a second set of at least three opposing weavable elements; wherein one of the three opposing, weavable elements of the first set is also one of the three opposing, weavable elements of the second set; and wherein one of the first set of three opposing, weavable elements is disposed on a first plane and the other two of the first set of three opposing weavable elements are disposed on a second plane; and wherein one of the second set of three opposing, weavable elements is disposed on the first plane and the other two of the second set of three opposing weavable elements is disposed on the second plane.

12. The device of claim 11, wherein the opposing, weavable elements on the second plane are substantially parallel.

13. The device of claim 12, wherein the opposing, weavable element of the first set of opposing, weavable elements disposed on the first plane is shaped substantially different from the opposing, weavable element of the second set of opposing, weavable elements disposed on the first plane.

14. A kit for securing two or more clothing garment shoulder straps while being worn by a user, wherein the kit includes:

a securing device having a length of a long, thin material with a first end, a second end, and a body extending between the first end and the second end, the long, thin material including a multiplicity of opposing, weavable elements, a first of the multiplicity of opposing weavable elements being continuous with a first end of a second of the multiplicity of the opposing, weavable elements at a first junction, a first end of a third of the multiplicity of opposing, weavable elements being continuous with a second end of the second of the multiplicity of the opposing, weavable elements at a second junction, and including a fourth opposing, weavable element continuous with a second end of the third of the multiplicity of the opposing, weavable elements at a third junction; the opposing weavable elements being constructed and arranged relatively to intertwine with at least two adjacent clothing garment shoulder straps while being worn, and thereby secure such straps together while being worn; and wherein the first end of the length is constructed with an attachment eye, the size of the device being limited to a size wearable by the user by intertwining with the shoulder straps while being worn; and a detachable adornment operable to attach to and detach from the attachment point adjacent to secured shoulder straps while being worn.

15. The kit of claim 14, wherein the attachment eye is formed on the first end of the length.

16. A method for securing at least two adjacent clothing garment shoulder straps together while being worn by a user, which comprises:

providing a securing device having length of a long, thin material, the long, thin material having a first end, a second end, and a body section extending between the first end and the second end, the long, thin material being formed with a multiplicity of opposing, weavable elements, wherein a first of the multiplicity of opposing, weavable elements is continuous with a first end of a second of the multiplicity of the opposing, weavable elements at a first junction, a first end of a third of the multiplicity of opposing, weavable elements is continuous with a second end of the second of the multiplicity of the opposing, weavable elements at a second junction, and wherein a fourth of the multiplicity of opposing, weavable elements is continuous with a second end of the third of the multiplicity of the opposing, weavable elements at a third junction;

placing at least two garment shoulder straps together while being worn by a user to form a strap group; and performing a weave wherein the strap group is intertwined with the opposing weavable elements, fed past the opposing, weavable elements with the first and second junctions encasing the strap group at opposite sides while being worn, the size of the device being limited to a size wearable by a user by intertwining with the strap group while being worn.

17. The method of claim 16, wherein performing the weave includes feeding the strap group alternately over and then under consecutively arranged opposing, weavable elements.

* * * * *